US005716049A

United States Patent [19]

Pundzus et al.

[11] Patent Number: 5,716,049

[45] Date of Patent: Feb. 10, 1998

[54] PINBALL MACHINE TARGET ASSEMBLY

[76] Inventors: James J. Pundzus, 35402 Kenneth, Lake Villa, Ill. 60046; John E. Mitchell, 3050 Arthur Ct., Apt. B4, Waukegan, Ill. 60085; Billy C. Oliver, Jr., 1062 Lakehurst Dr., Apt. 103, Waukegan, Ill. 60085

[21] Appl. No.: 577,697

[22] Filed: Dec. 22, 1995

Related U.S. Application Data

[63] Continuation-in-part of Ser. No. 336,306, Nov. 8, 1994, abandoned.

[51] Int. Cl.[6] ..... A63F 7/30

[52] U.S. Cl. ..... 773/118 R; 273/127 R; 273/127 D; 273/118.4

[58] Field of Search ..... 273/118, 119, 273/121, 127 R, 127 B, 127 C, 127 D

[56] References Cited

U.S. PATENT DOCUMENTS

| | | | |
|---|---|---|---|
| 3,627,318 | 12/1971 | Garbary et al. | 273/127 D X |
| 4,257,604 | 3/1981 | Grabel et al. | 273/127 R |
| 4,322,082 | 3/1982 | Peters . | |
| 4,438,929 | 3/1984 | Peters | 273/127 R |
| 4,460,175 | 7/1984 | Krynski | 273/127 R |
| 4,773,646 | 9/1988 | Joos, Jr. et al. . | |
| 4,934,699 | 6/1990 | Kaminkow et al. . | |
| 5,158,290 | 10/1992 | Norris et al. . | |
| 5,158,292 | 10/1992 | Hanchar | 273/127 R X |
| 5,255,916 | 10/1993 | Bleich . | |
| 5,322,282 | 6/1994 | Lund et al. . | |
| 5,322,283 | 6/1994 | Ritchie et al. . | |

*Primary Examiner*—Raleigh W. Chiu
*Attorney, Agent, or Firm*—Fitch, Even, Tabin & Flannery

[57] ABSTRACT

A target and associated impact sensing mechanism is provided including a target head above the pinball playing surface which is movable from a first position above the playing surface to a second position above the playing surface upon receiving a sufficient impact force from the pinball. A switch actuator depends from the head and extends below the playing surface in the interior of the pinball machine. A switch has an open state and a closed state with the switch actuator changing the switch from its open state to its closed state as an incident of the movement of the target head from the first position to the second position. A housing mount is provided below the playing surface containing the switch to protect the switch from the environment and to support the target head above the playing surface with the actuator in position to change the switch from its open to its closed state. By containing the switch in the housing mount, the switch is protected from exposure to dust and dirt and the like and thereby more reliably carries current to accurately sense pinball impacts. The housing mount can also be reversible so as to be capable of being mounted in different orientations under the playing surface while maintaining the target head in position to receive pinball impacts providing flexibility in designing the pinball game scheme and layout. In addition, as the target assembly herein does not rely upon the resiliency of leaf spring members for rebounding the pinball off of the target impact surface, the response of the pinball after impacting the target herein is more consistent over longer time periods than leaf spring type targets.

33 Claims, 30 Drawing Sheets

PINBALL MACHINE TARGET ASSEMBLY

CROSS-REFERENCE TO RELATED APPLICATION

This application is a continuation-in-part of U.S. patent application Ser. No. 08/336,306, filed on Nov. 8, 1994 now abandoned.

FIELD OF THE INVENTION

This invention relates to a pinball impact receiving and impact sensing apparatus and, more particularly, to a target assembly in a pinball machine for receiving an impact force from a pinball traveling along the playing surface which provides a consistent pinball rebound response and accurately registers scoring hits on the target.

BACKGROUND OF THE INVENTION

Pinball machines typically are in the form of an elongate rectangular housing, the top of which is inclined from its rear towards the front to provide a slightly downwardly angled playing surface on which the pinball travels. At the forward, lower end of the machine, a pair of flipper buttons are operated by a player on either side of the housing to control paddles, normally provided at the front, lower end of the playing surface, although pinball propelling paddles can be provided at other locations along the playing surface as well. The paddles are operated to propel the pinball, a metal sphere of approximately 80 grams, as it travels down the playing surface by force of gravity towards the paddles back upward along the playing surface to maintain the ball in action and prevent the ball from "draining" down past the paddles and ending the play with a particular pinball. The paddles can propel the steel balls with some force with pinballs reaching speeds of approximately 6 to 8 miles per hour along the playing surface.

The overriding object in pinball games is to score as many points as possible with the allotted amount of pinballs provided in a game, typically in the range of three to five balls. A player can score points in a wide variety of fashions by causing the pinball to move along the playing surface into contact with point-generating mechanisms provided on and above the playing surface. In addition to generating points, pinball contact with these mechanisms can activate other game features that may, for example, change the configuration of the playing surface and/or the obstacles on the playing surface, such as by raising and lowering targets, ramp surfaces leading to targets, etc. Typically, sensing mechanisms are associated with the various impact receiving features of the machine with the sensing mechanisms delivering an electrical signal to the game controller or microprocessor which, in turn, can register points and/or activate other game features, again depending on the type of target hit. The electronics for the pinball machine including most of the connections and lead wires are provided beneath the playing surface in the interior of the pinball machine housing with points registered for player view on a vertical scoreboard extending from the upper rear of the pinball housing.

Some of the more common point generating targets include bumper targets and drop targets. Bumper targets or jet targets are provided above the playing surface and commonly have opposing upper and lower dish-shaped members. These targets can be struck and activated by a pinball from any direction 360° around the circumference of the bumper. When a pinball strikes the jet bumper by impact with the lower dish-shaped plate, a leaf switch is tripped which signals the controller to activate a solenoid. The solenoid causes the upper plate to move downward towards the playing surface immediately upon impact to squeeze and shoot the pinball away from the bumper on the playing surface. The plunger shaft of the solenoid is spring loaded so that after pinball impact and propelling the pinball away from the bumper, the upper plate is then returned to its raised position with the bumper ready for further pinball contacts.

Drop targets typically have intermediate transverse surfaces which are supported by a ledge provided on the drop target's mounting bracket below the playing surface. The targets are urged forwardly and downwardly so that the target's transverse surfaces are securely on the ledge until a pinball contacts the front of the target to push the target rearwardly against the forward bias and disengage the transverse surfaces from the support ledge. Once this occurs, the downward bias pulls the target so that it retracts below the playing surface. To return the drop targets to a ready position for contact by pinballs, the game controller generates a signal, typically after a ball play has ended and before another begins. This signal activates a solenoid causing a lifting plate connected to the solenoid plunger shaft to push on the bottom of the drop targets to move the drop target transverse surfaces past and then onto the support ledge.

Face targets are not driven, such as the solenoid driven bumpers and drop targets, and are also commonly used in pinball games and, as such, their construction is well known. In conventional non-driven target assemblies, a plastic target head is riveted to a elongate piece of spring metal with the head supported above the playing surface. The elongate spring metal piece extends from the head below the playing surface where it is riveted to a plurality of additional spring metal pieces which together cooperate to form a leaf spring switching mechanism. In this fashion, the target head is cantilevered from its lower riveted connection and when struck by a pinball bends back against the resistance of the spring metal mounting piece. The bottom riveting below the playing surface also connects the leaf spring metal pieces to a rigid backing bar extending from below the playing surface to above the playing surface behind the target head with the rigid backing bar having a piece of foam attached at its upper end behind the target head to cushion the target as it bends back upon impact from a pinball. After engaging and compressing the foam, the target head rebounds back under the influence of the spring mounting pieces to propel the ball away from the target head on the playing surface.

An L-shaped mounting bracket is also riveted to the spring metal pieces and the rigid backing bar below the playing surface with the horizontal apertured mounting portion of the bracket preferably extending forwardly of the target face to provide a front mount target assembly. It is also known to rivet the L-shaped bracket directly behind the backing bar so that the horizontal mounting portion extends rearwardly to provide a rear mount target assembly. However, once riveted and assembled, the target assembly is permanently maintained in either its forward mount or rear mount form, thus restricting the mounting arrangements for these target assemblies to their predetermined form.

Electrical attachment tabs extend from the bottom of the leaf spring members exposed underneath the pinball playing surface in the housing for soldering various electrical leads and components thereto to complete the leaf spring switching mechanism. Thus, the electrical connections require soldering and are exposed to the environment of the pinball housing, including dust and dirt therein which can affect the reliability of these connections.

Typically, two of the leaf spring members have a rectifying diode soldered therebetween with a third tab having an electrical connector attached thereto to provide an electrical path to the controller when the leaf spring switch circuit is closed as caused by sufficient impact from a pinball with the target. In other words, the switch circuit will normally be in an open state until the target head is impacted with sufficient impact force from a pinball to cause the leaf spring support to bend rearwardly into engagement with a contact on the upper end of a leaf spring member behind it exposed above the playing surface and which is electrically connected at its other exposed tab end to the switching circuit. Once this contact is made, the circuit is closed with the game controller sensing the change in state of the circuit of the switching mechanism to register points and/or activate other game features. As is apparent from the above, the exposure both above and below the playing surface of electrical contacts and connections of the switching circuit can be a problematic and can either limit the switching mechanisms ability to sense target hits precisely, or conversely, to register false hits even when the pinball has not properly impacted the target head.

As previously mentioned, the object of pinball games is acquire points by operating the flipper paddles to propel the pinball across the playing surface and into contact with various targets, such as those point generating targets described above. By providing various types of targets in different situations and orientations, a pinball machine can be made to be a fairly challenging game even after repeated playings. However, particularly with profit-making pinball machines in arcades where players muse deposit money to play a pinball game, it is desirable for a player to be able to gradually improve upon repeated playings of the game. This provides the player with incentive to keep playing more games and, accordingly, to spend more money on the game.

Besides an acquired general familiarity with the game features and scoring of a particular pinball game upon repeated playings, it is also desirable for a player to be able to become better at determining the responses of the pinball after impacting the various obstacles, including the targets, provided on and above the field. This is not to say that the predictable responses may not be difficult responses for the player to counteract as otherwise the game would become too easy and not a challenge. If a player can master a pinball game relatively easily, they may lose interest in continuing play with the game and move on to other arcade games. Nevertheless, the response should be predictable enough so that the more experience a player has with a game, the greater their skill level will progress with respect to that particular pinball game as repeated playings should enhance their ability to handle the pinball's likely rebound responses off of these obstacles. Repeated playings should allow a player to observe and more readily counteract the rebound paths such as from the non-driven face target assemblies, as they should become more and more predictable through experience with playing the game.

The above-described multi-piece construction of the non-driven face target assemblies utilizing a leaf spring switch, however, does not lend itself to consistent, reproducible pinball responses, particularly after prolonged use as the various pieces, particularly the leaf spring members, tend to fatigue and/or break after repeated pinball impacts. As the spring members get older, their resiliency changes causing the pinball to rebound from the face target differently depending upon the age and strength of the spring members. The foam stop member on the backing bar also can have portions thereof which start to chip and break away thus changing the distance the target head travels in the rearward direction upon impact by a pinball and accordingly varying the leaf spring response.

In addition, these non-driven leaf spring type targets are often provided side-by-side in an array. It is desirable for targets in an array to have approximately the same response to pinball impacts. Often, this is difficult with the leaf spring type targets described above as the numerous pieces require precise assembly to maintain consistent tolerances from one target to the next in an array. Even with consistent tolerances in the targets in an array, the leaf spring members can vary in resiliency between targets thus requiring further fine tuning to achieve the desired consistency in target response throughout the target array. Also, after repeated uses, it is quite possible that one or more targets may see more frequent impacts from a pinball during an average game due to the game configuration and thus have its leaf spring members and other parts fatigue more rapidly than other less used targets in the array again leading to inconsistent responses from one target to the next within the array.

Another problem with respect to yielding consistent pinball responses is that the rivet securing the plastic target head to the elongate spring member projects forward through the target head and onto the impact surface of the target head so that the pinball does not always impact the flat face of the target head. Instead, when the pinball impacts against the rivet head on the impact face, the rebound of the pinball is changed from what normally would be expected if it had contacted the flat face.

For mounting these prior non-driven target assemblies, the pinball playing surface typically has a slot cut therein through which the leaf spring members can extend with the mounting bracket secured to the bottom of the playing surface by way of screws or other fastening members. As the backing bar and the elongate spring member to which the target head is attached typically are not in contact with the sides of the slot, the entire target assembly is not tightly fitted in the slot and can tend to loosen over time after repeated pinball impacts as the fasteners attaching the bracket to the bottom of the playing surface absorb a significant amount of the impact energy of the ball. As a result of this loosening of the leaf spring type target assemblies, the impact surface of the target head can become skewed with respect to its original orientation, again leading to inconsistencies in the response of the pinball after impacting the target head and between targets in an array.

Because the backing bar extends over the playing surface behind the target head, and the rivet from the elongate spring member extends through the target head, it is difficult for a light source to be mounted to direct light through the target head to illuminate the target head as is often desirable in pinball games. Accordingly, a light source must be mounted in proximity to the target head to illuminate the region around the target head. In addition, due to the location of the backing bar and the target head mounting rivet and the opaque plastic material from which the target heads are typically formed, the light source cannot readily direct light through the target head for illumination thereof and the light instead must be directed to illuminate the region around the target.

As is apparent from the above, there is a need for a non-driven face target which provides consistent pinball responses over prolonged use and repeated pinball impacts. The face target should also have a sensing mechanism which reliably indicates proper point scoring hits on the target head. It is also desirable for such a target to have a fewer number of parts which are relatively easily assembled together to lower assembly time and costs. Preferably, the target should be readily oriented in either a front mount or a rear mount configuration to provide greater flexibility in utilizing the space in a pinball machine. Further, there is a need for a face target which has a secure and stable mounting arrangement limiting loosening over time and, accordingly, maintaining a consistent orientation above the playing surface. Finally, there is a need for a non-driven target which allows a light source to direct light through the target head to illuminate the same.

SUMMARY OF THE INVENTION

In accordance with the present invention, a target and associated impact sensing mechanism is provided which overcomes the aforementioned problems of the prior art.

In one form of the invention, a target head is provided above the pinball playing surface and is movable from a first position above the playing surface to a second position above the playing surface upon receiving a sufficient impact force from the pinball. A switch actuator depends from the head and extends below the playing surface in the interior of the pinball machine. A switch has an open state and a closed state with the switch actuator changing the switch from its open state to its closed state as an incident of the movement of the target head from the first position to the second position. A housing mount is provided below the playing surface containing the switch to protect the switch from the environment and to support the target head above the playing surface with the actuator in position to change the switch from its open to its closed state. By containing the switch in the housing mount, the switch is protected from exposure to dust and dirt and the like and thereby more reliably carries current to accurately sense pinball impacts.

In one form, the housing mount has top and bottom walls, forward and rear walls, and sidewalls extending between the forward and rear walls and the top and bottom walls to define a switch chamber in which the switch is mounted.

Preferably, the switch actuator includes a target lever arm and a pivot between the target lever arm and the target head with the target head pivoting about the pivot as it moves between the first and second positions. The target head, pivot and target lever arm can be integrally formed from a plastic material. Further, the pivot can be a pivot shaft extending transversely to the target lever arm. The Housing mount can include a first housing member and a second housing member which can be connected to capture and define a seat for the pivot shaft in the housing mount. By eliminating the various leaf spring members including the elongate spring mounting member connected to the target head, and by use of a unitary plastic part which pivots in the housing mount, the target assembly herein does not have to contend with spring metal fatigue such as with the previously-described leaf spring type face targets using the cantilevered spring metal members and thus provides a more consistent response over time from a pinball impacting the target head.

In one form, the playing surface has a slot formed therein and the housing mount extends from the slot downwardly into the pinball machine interior with the target head adjacent the slot above the playing surface. The slot is generally bounded by first and second spaced laterally extending walls and the housing mount can have first and second projection members spaced to engage the walls without projecting above the playing surface and acting as stops to limit the movement of the target head. With the projection members spaced to engage the slot walls, the inventive target assembly is substantially limited from rotation in the slot caused by repeated pinball impacts as opposed to the prior face target assemblies.

In one form, the housing mount can have a first portion extending downwardly from the playing surface and a second portion extending transversely to the first portion to attach to the bottom of the playing surface. The target head can have an impact receiving surface facing in a first direction with the housing transverse portion being reversible relative to the target so that it can be attached to the playing surface bottom extending in either the first direction or a second direction opposite to the first direction with the target head remaining facing in the first direction. The prior face targets mounting bracket did not allow for such reversibility as the mounting brackets came permanently preassembled so that the face target assemblies were either a front mount or a rear mount assembly and could not be used as both. This can place significant constraints upon pinball machine design and reduce flexibility in the location of other targets and pinball game features on and over the pinball playing surface, especially around the target head.

In one form, the switch can include an activation plunger having a first position where it is extended with the switch in the open state and a second position where it is depressed by the switch actuator with the switch in the closed state. The plunger is normally biased to its first extended position and it is moved to the second depressed position against the bias when the target head moves by force of the pinball from its first position to its second position. The target head has an impact receiving surface and the housing mount supports the head so that the target head surface moves through a predetermined angular path relative to the playing surface as the head moves between its first and second position with the plunger bias causing the target head to rebound back to its first position after reaching its second position to propel the pinball away from the target head. As the target assembly herein does not rely upon the resiliency of the leaf spring members for rebounding the pinball off of the target impact surface, the response of the pinball after impacting the target herein is more consistent over longer time periods than the leaf spring type targets of the prior art.

Preferably, a light source is provided with light from the source directed through the target head wherein the target head is formed from a translucent material. Preferably, the light source is mounted in the housing mount.

In one form, the pinball machine has a game controller and the switch has a switch circuit. The housing mount can include a connector capturing surface for tightly capturing an electrical socket connector against the housing to electrically connect the game controller to the switch circuit. Thus, the housing mount herein does not require electrical connections to be soldered together as in the prior art, reducing assembly time and costs.

In another form of the invention, the target assembly is provided for receiving an impact force from the pinball with the pinball rebounding therefrom onto the playing surface without being retained by the target. A target head having an impact surface is supported in a first predetermined position above the playing surface for receiving an impact force from a pinball and moving to a second predetermined position above the playing surface in response to the impact force on the impact surface. A target body extends from the target head below the playing surface with the target body being urged by a predetermined bias force to position the target head in its first predetermined position. The target head moves from its first to its second predetermined position against the predetermined bias force exerted on the target body and then rebounds back to its first predetermined position under the influence of the bias force. A support is mounted below the playing surface for supporting the target body. The target head is formed integrally with the target body such that only the target head of the target assembly protrudes above the playing surface with the entire extent of the target impact surface being exposed to pinball impacts. As only the target head of the assembly is over the playing surface, the present target assembly provides much greater flexibility in mounting other targets and devices, such as light sources, therearound. In addition, as the entire extent of the target head is exposed to pinball impacts, the predictability of the rebound of the pinball from the impact surface of the target head is improved versus the riveted head of prior face targets.

In one form, the target body can include an elongate bar portion depending from the target head, a lever arm having a bottom end which is urged by the predetermined bias force, and a pivot disposed between the elongate bar and the lever arm about which the target body pivots as the target head moves from one of its first and second predetermined positions to the other of its first and second predetermined positions. The pivot can be a pivot shaft extending transversely to the elongate bar and the lever arm with the target head, elongate bar portion, the pivot shaft and the lever arm being integrally formed from a plastic material.

The target impact surface can be angled relative to the playing surface at a preselected angle to provide the pinball with a consistent path upon rebounding from the target impact surface. In prior leaf spring type face targets, the target head generally extends vertically or perpendicularly to the playing surface with this orientation of the target head being subject to change over time after repeated pinball impacts due to several factors associated with their construction, including fatigue of the spring metal parts employed and shifting of the mounting arrangement, as previously described. Again, the improved consistency in pinball response afforded by the targets herein is desirable such that as players gain experience they can develop their skills and more readily respond in kind to the path of the ball rebounding from the impact surface. The inventive target can be more precisely designed than the prior face targets to provide a wide variety of rebound responses which will be substantially consistent throughout the life of the target assembly.

In one preferred form, the target impact surface has central and side sections and a predetermined convex shape with the central section extending outwardly beyond the side sections of the impact surface. As will be apparent to one skilled in the art, the target impact surface can take on a wide variety of predetermined shapes to vary the pinball response when contacting the impact surface and increase the variations of predictable pinball rebound paths which, accordingly, generally can render the game more complicated and/or provide more challenging play.

The target head can be formed from a translucent material having a rear surface opposite to the impact receiving surface. In one preferred form, the rear surface can be fluted to provide a radially finned appearance to the impact surface upon directing light from a source through the rear surface. As will be apparent, by fabricating the target head from a translucent material which allows light to be directed therethrough, the rear surface can take on a wide variety of configurations which will be visible upon directing light through the target head to provide the impact surface with a more aesthetically pleasing appearance.

In yet another form of the invention, a pinball impact receiving and impact sensing apparatus is provided having an elongate member with a first section extending above the pinball machine playing surface in a first predetermined position and having a first predetermined orientation relative to the playing surface for receiving an impact force. A second section extends below the pinball machine playing surface. A sensing mechanism for sensing movement of the first section to a second predetermined position above the playing surface upon receiving the impact force is provided. A reversible mount supports the elongate member first section above the playing surface at the first predetermined position in its first predetermined orientation. The reversible support has a transverse portion adapted to be secured to the bottom of the playing surface extending in one of a first direction relative to the first section orientation and a second direction substantially opposite to the first direction with the elongate member first section in the predetermined orientation. The transverse portion is capable of being reversed to extend in the other of the first and second directions with the first section in its predetermined orientation. As previously mentioned, such interchangeability of the mount provides greater design flexibility for pinball game designers when using the target assemblies herein over prior art leaf spring type target assemblies. In addition, manufacturing costs are reduced as both mounting types of target assemblies no longer need to be fabricated. Instead, the targets herein with the reversible mount can be used with the mount in either orientation depending on the design needs and requirements of a particular pinball machine.

The reversible mount can include a first housing member and a second housing member connectable to each other to capture an elongate member portion and allow movement of the elongate member first section between the first and second positions with the mount secured below the playing surface. The first and second housing members can be formed from a plastic material. One of the housing members can include a flanged locked member and the other housing member can have a flange receiving track with the locked member and track cooperating to releasably connect the housing members to each other without the use of distinct fastening members. As the housing members are releasably connected to one another, they are readily changeable so that the mount transverse portion can be reversed depending on the particular pinball machine requirements. In addition, the elimination of distinct fastening members, such as screws and/or rivets, can save significant time in assembly over the leaf spring type face targets.

In one form, the sensing mechanism includes a switch having an activation plunger and the elongate member second section includes a lever arm portion engaged with the activation plunger for depressing the plunger as the elongate member first section moves from its first predetermined to its second predetermined position. The first and second housing members can each include a pair of openings through which the lever arm and plunger can extend so that with the first section in its first predetermined position, the lever arm can engage the plunger at a position exterior of the housing with the lever arm and plunger extending through the corresponding pair of openings of either one of the first or second housing members. The pair of openings in both the first and second housing members allows the reversible mount to be used as a forward mount with the lever arm and plunger extending through the openings in one of the housing members or, alternatively, as a rear mount with the lever arm and plunger extending through the openings of the other housing member.

The switch can be mounted on a printed circuit board having electrical leads extending therefrom for transmitting an electrical signal from the switch to the game controller when the activation plunger is depressed.

The switch can be mounted to the reversible mount with the reversible mount including a pair of opposed apertures to allow the switch to be reversed so that the plunger can extend through either one of the apertures into engagement with the lever arm. Again, by the provision of the opposed switch plunger apertures in the reversible mount, the mount can be used as a forward mount with the plunger extending from one side of the mount through one of the apertures or, alternatively, with the mount reversed, as a rear mount with the switch plunger extending from the other aperture on the other side of the reversible mount.

DETAILED DESCRIPTION OF THE PREFERRED EMBODIMENT

Figure 1:
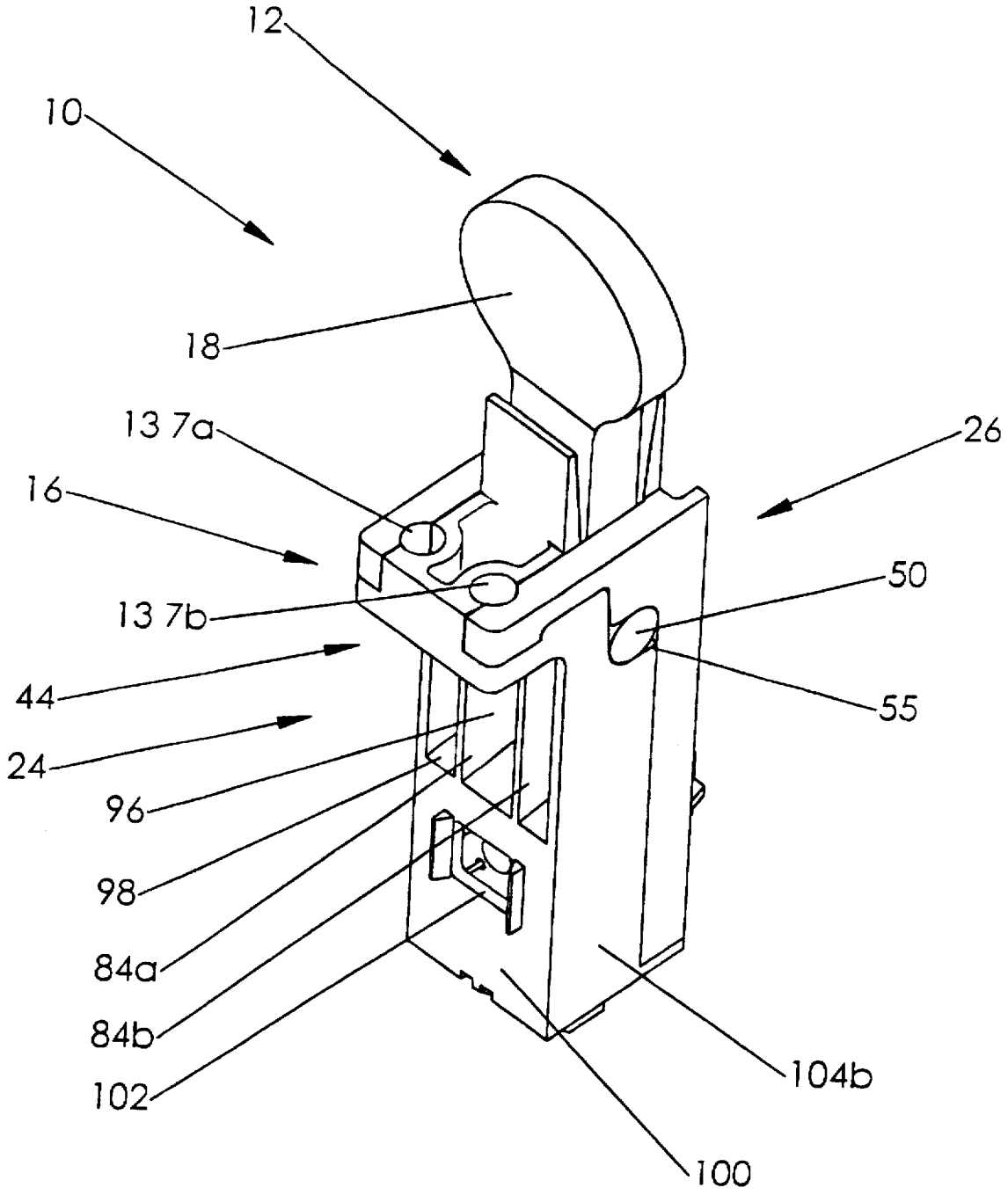
FIG. 1 is a perspective view of a target assembly according to the present invention.
Figure 2:
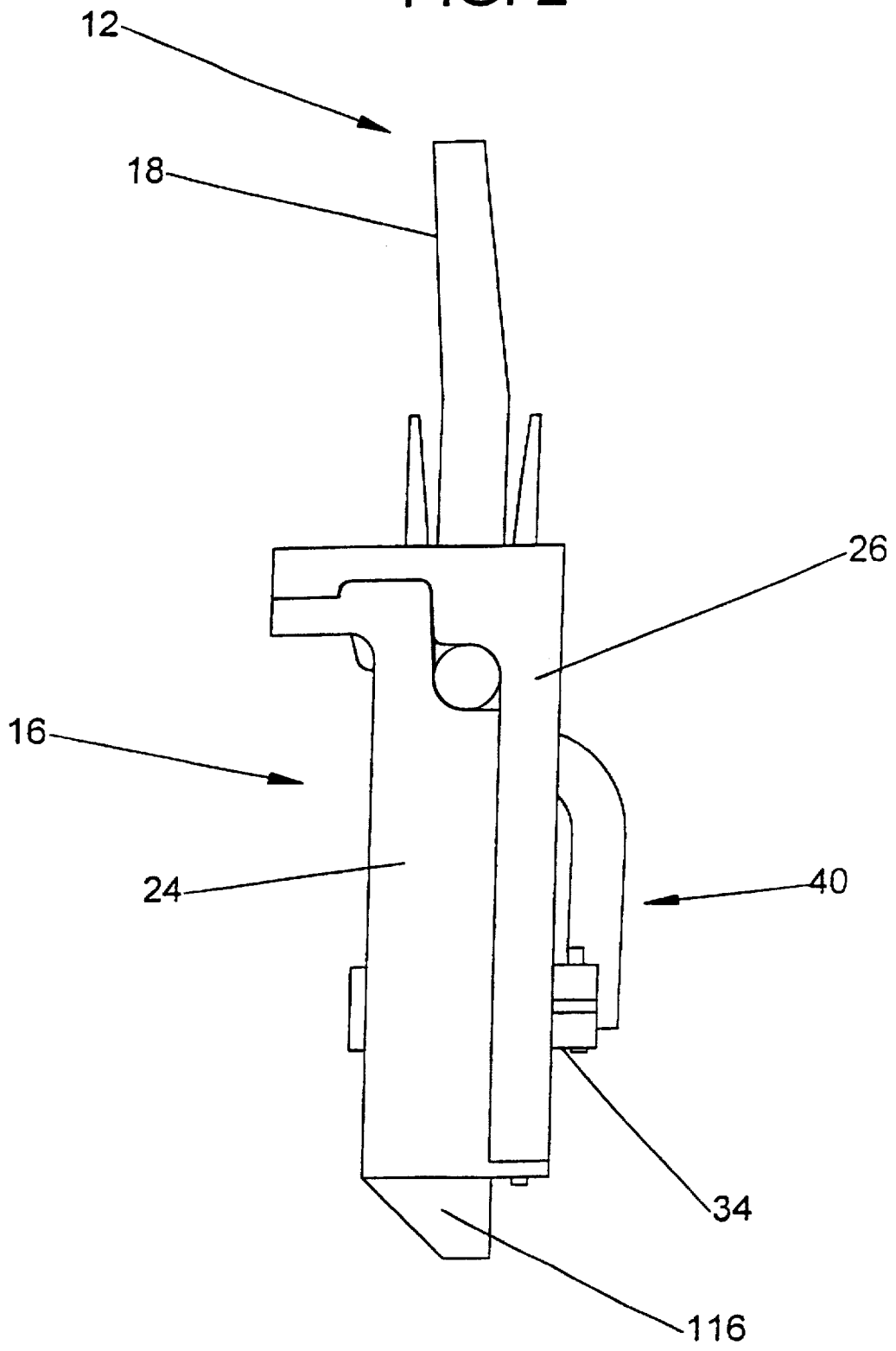
FIG. 2 is a side elevational view of the target assembly of FIG. 1 showing a target head and a lever arm with a reversible housing mount assembled in its front mount orientation and including a switch activation plunger extended in engagement with the bottom of the lever arm.
Figure 10:
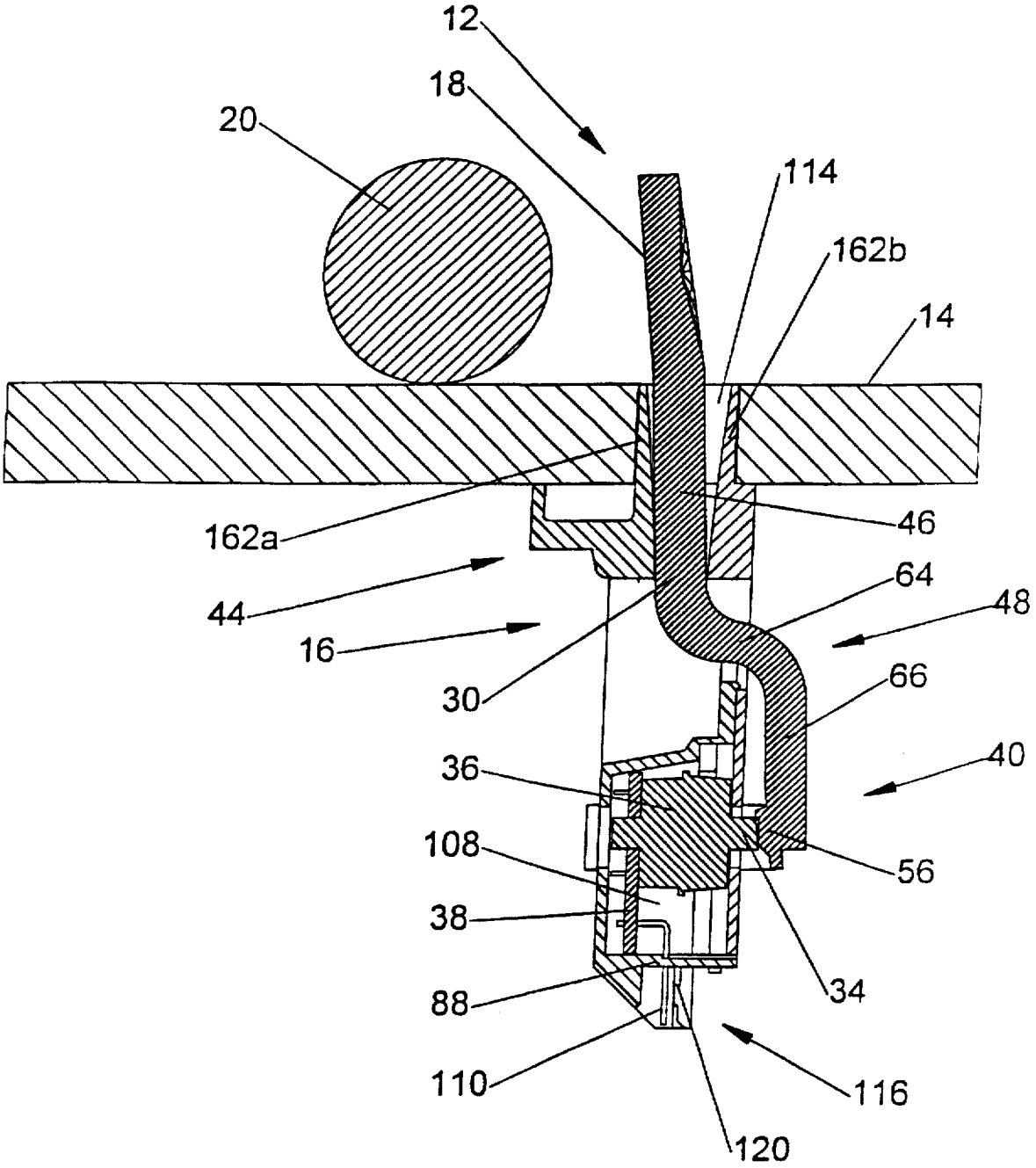
FIG. 10 is a side elevational view of the front mount target assembly of FIG. 1 with the housing mount attached to the bottom of the playing surface and projection members extending from the housing mount in engagement with sides of a slot formed in the playing surface for the target.
Figure 11:
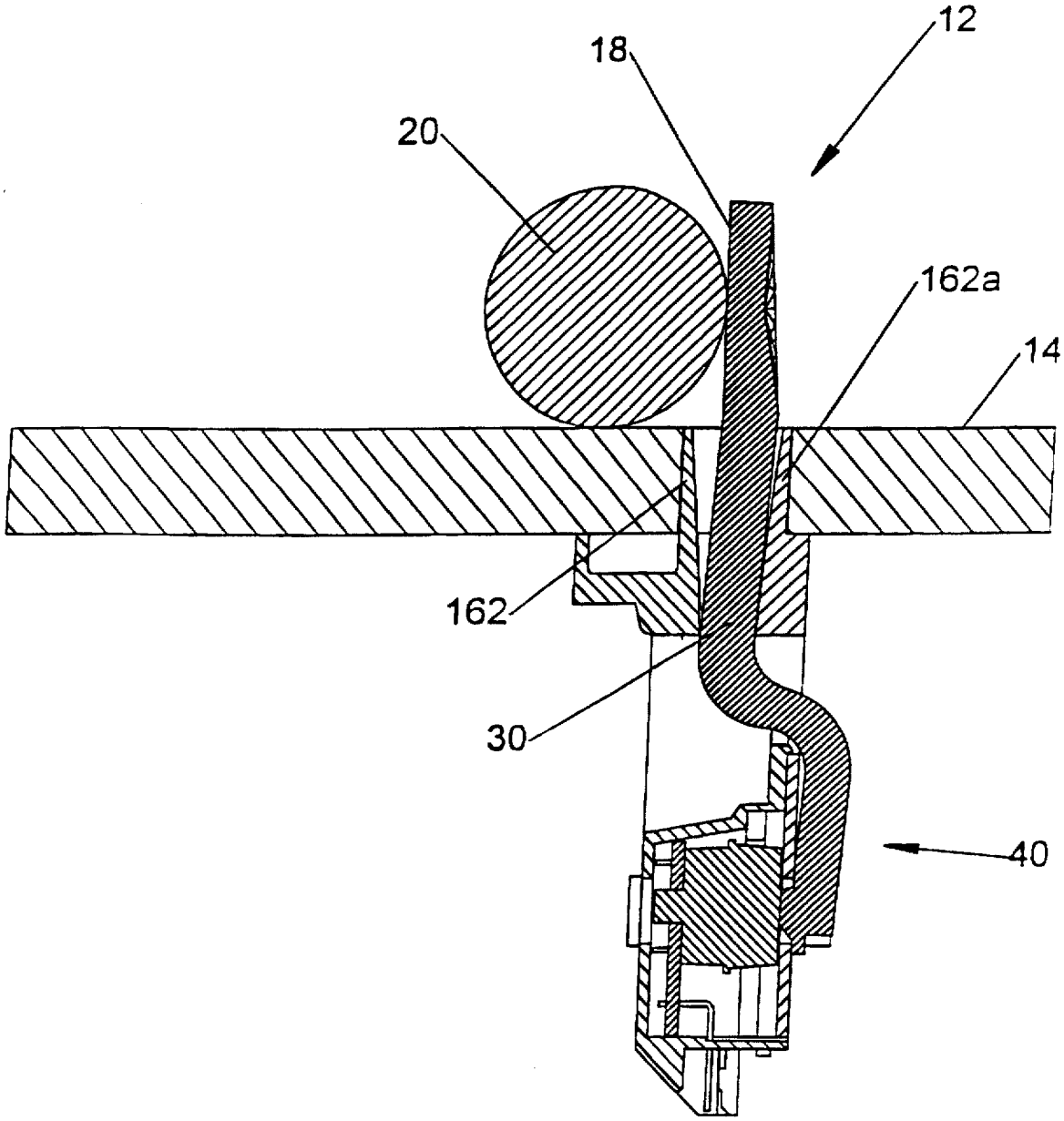
FIG. 11 is a side elevational view, similar to FIG. 10, showing a pinball contacting an impact receiving surface of the target head pivoting the target lever arm to depress the switch activation plunger.

The pinball impact receiving and sensing mechanism or target assembly 10 according to the present invention is illustrated in FIG. 1. In the preferred form, the impact receiving and sensing mechanism 10 has a target head 12 supported above a pinball playing surface 14 by a reversible mount 16 in position for receiving impacts against the target head impact receiving surface 18 with a pinball 20 propelled thereagainst, as seen in FIGS. 10 and 11. It will be understood that the present invention also contemplates placing intermediate members between the impact receiving surface 18 and the pinball 20 to transmit the impact force of the pinball 20 thereto such as with the sling device 22 shown in FIGS. 29 and 30 and to be described in more detail hereafter.

The reversible mount 16 can include a first housing member 24 and a second housing member 26. The target head 12 can be part of a unitary elongate member 28 with the target head 12 disposed at the top thereof. The first and second housing members 24 and 26 can be connected to each other and cooperate to capture an intermediate pivot portion 30 of the elongate member 28 while supporting the target head 12 over the playing head surface 14.

Figure 4:
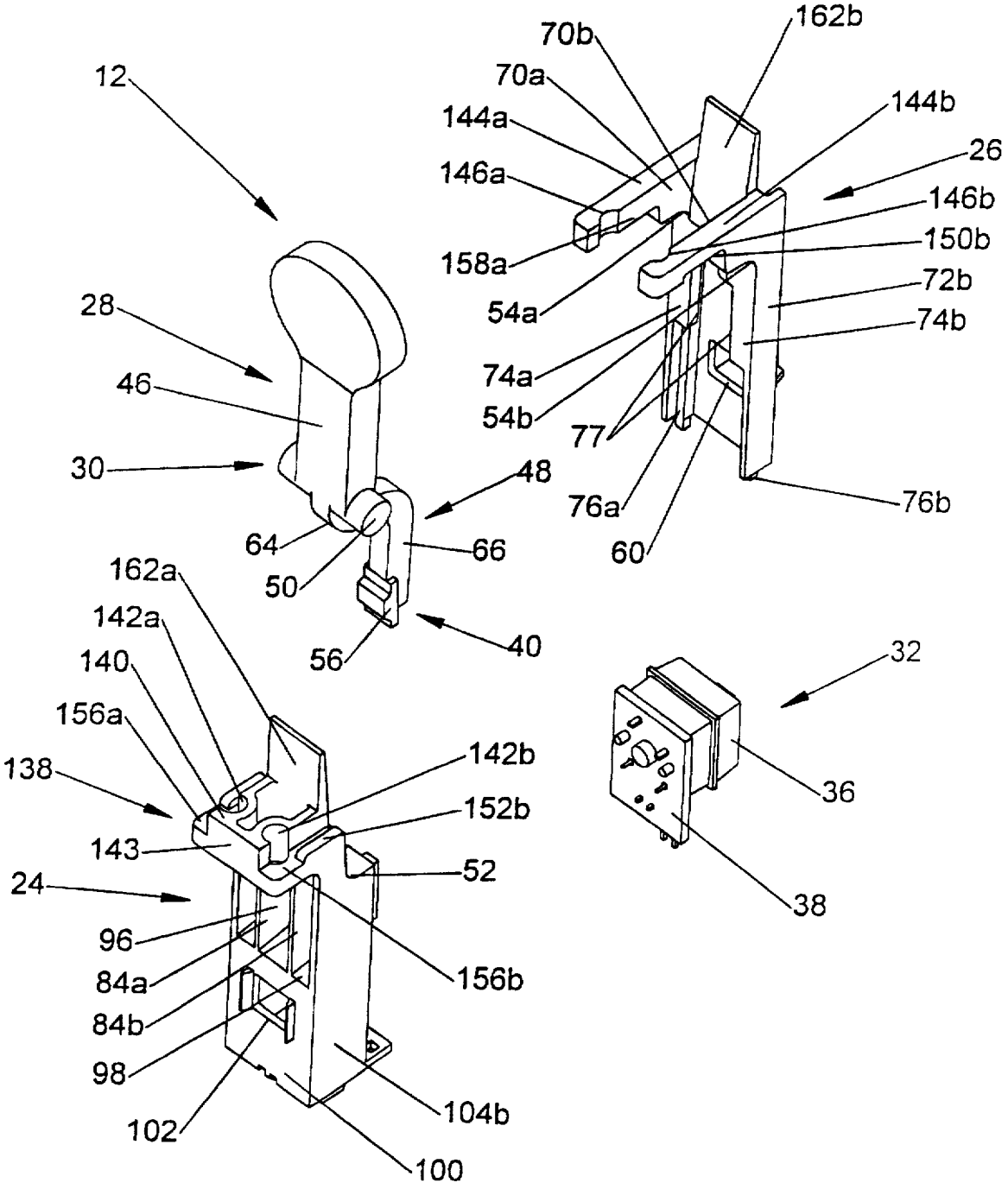
FIG. 4 is an exploded perspective view of the front mount target assembly of FIG. 1 showing the integral target head and lever arm, including a transverse pivot shaft therebetween, a first housing member and a second housing member for capturing the pivot shaft therebetween and a microswitch mounted to a printed circuit board.
Figure 6:
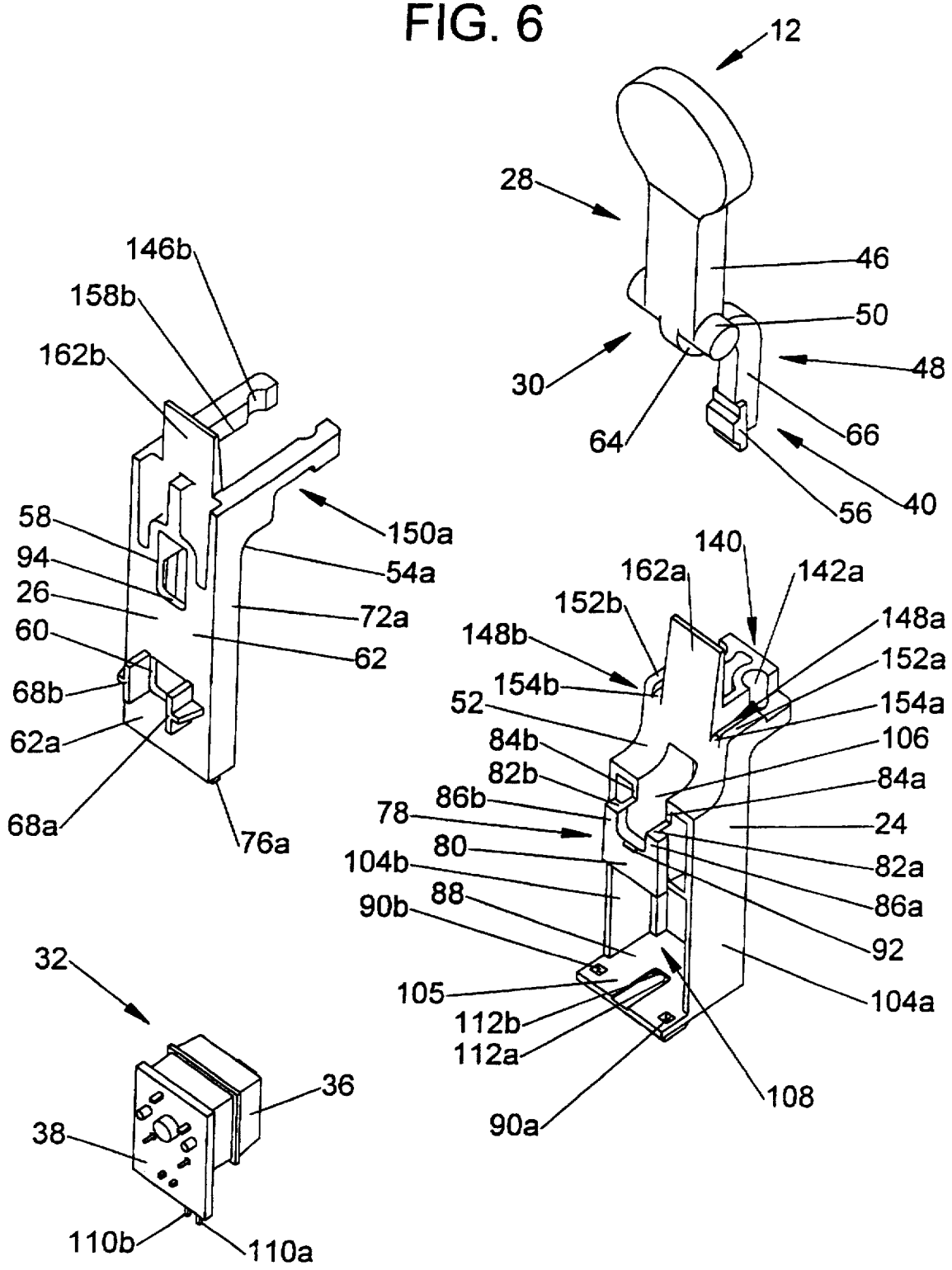
FIG. 6 is an exploded view of the rear mount target assembly of FIG. 5.
Figure 7:
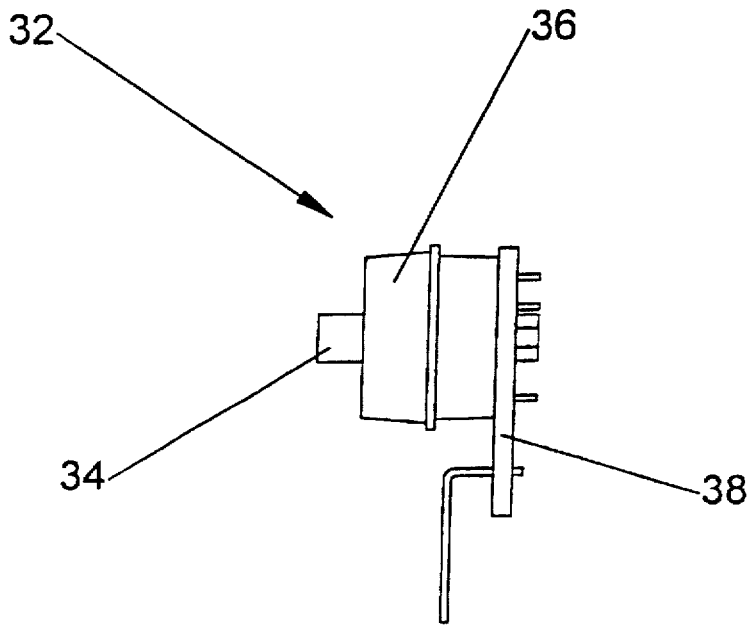
FIG. 7 is a side elevational view of the microswitch and printed circuit board.

As best seen in FIGS. 4, 6 and 7, a switch device 32 is provided and is part of the sensing mechanism for sensing movement of the target head 12 upon receiving an impact force from the pinball 20. The preferred switch device 32 can include a microswitch commercially available from Cherry Electrical Products Corporation which has an activation plunger 34 biased to an extended position exterior of the switch housing 36. The microswitch 32 can be mounted to a printed circuit board 38 which has conductor paths (not shown) for the switch circuit deposited or etched thereon, as is known. The microswitch 32 and printed circuit board 38 are mounted in the reversible mount 16 such that the activation plunger 34 extends therefrom into engagement with the lower end 40 of the elongate member 28. With the switch 32 and printed circuit board 38 mounted in the reversible mount 16, the electrical components and connections of the sensing mechanism herein are protected from the environment so as to improve the current carrying reliability of the sensing mechanism and thereby more accurately indicate target hits with the pinball game controller (not shown).

Figure 15A:
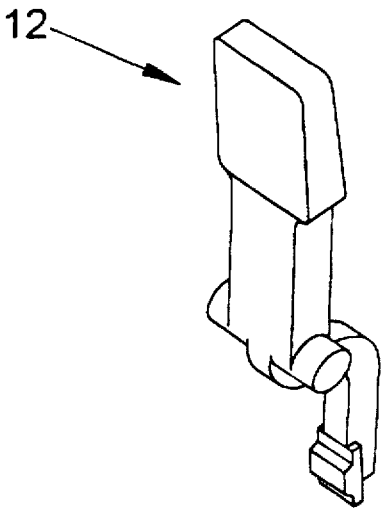
FIGS. 15A–15C are perspective views of various shapes of target heads according to the present invention.
Figure 15B:
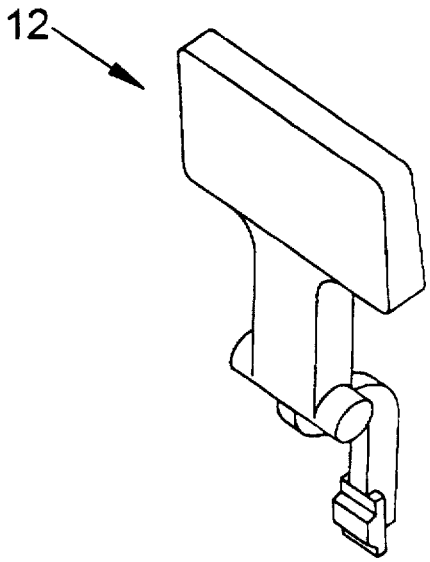
Figure 15C:
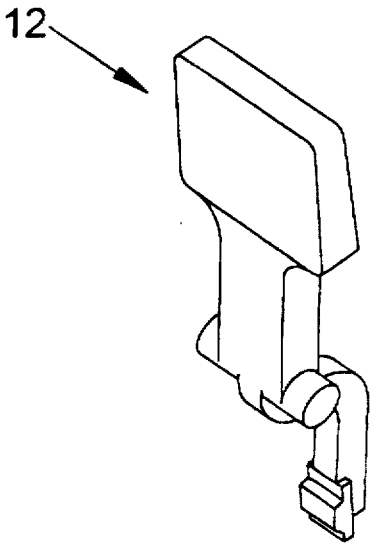

Referring to FIGS. 10 and 11, the front mount target assembly 10 illustrated in FIGS. 1–4 is shown mounted in its operative position in a pinball machine with the reversible mount 16 below the playing surface 14 and only the target head 12 protruding thereabove for receiving an impact from pinball 20. As the target head 12 is part of unitary elongate member 28 which has pivot 30 supported and captured in the reversible mount 16 below the playing surface 14 with the target head 12 supported in position above the playing surface 14 by the mount 16, no other portions of the target assembly 10 protrude above the playing surface 14 other than the target head 12. This is an improvement over the previously-described leaf spring type target assemblies which utilize rivets to assemble and make connections between various elongate spring steel members extending above the playing surface, such as the spring steel member to which the corresponding plastic target head is riveted above the playing surface. It will also be apparent that the target head 12 can take on a wide variety of shapes, such as illustrated in FIGS. 15A–15C.

Figure 12:
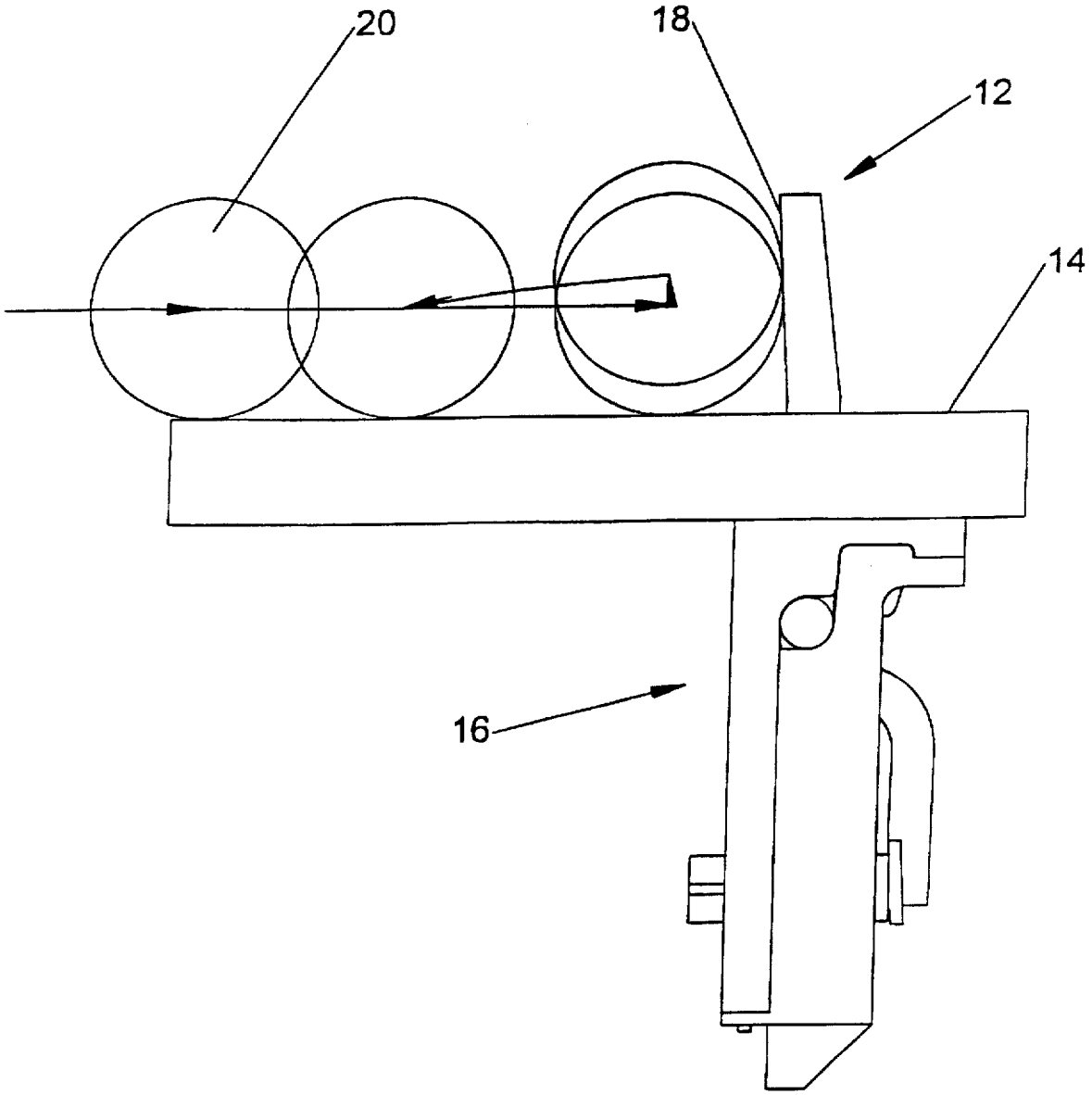
FIG. 12 is a side elevational view of the rear mount target assembly showing the impact receiving surface angled at a preselected angle of approximately 1° forward from the vertical relative to the playing surface and the path of the pinball when impacting and rebounding therefrom.
Figure 13:
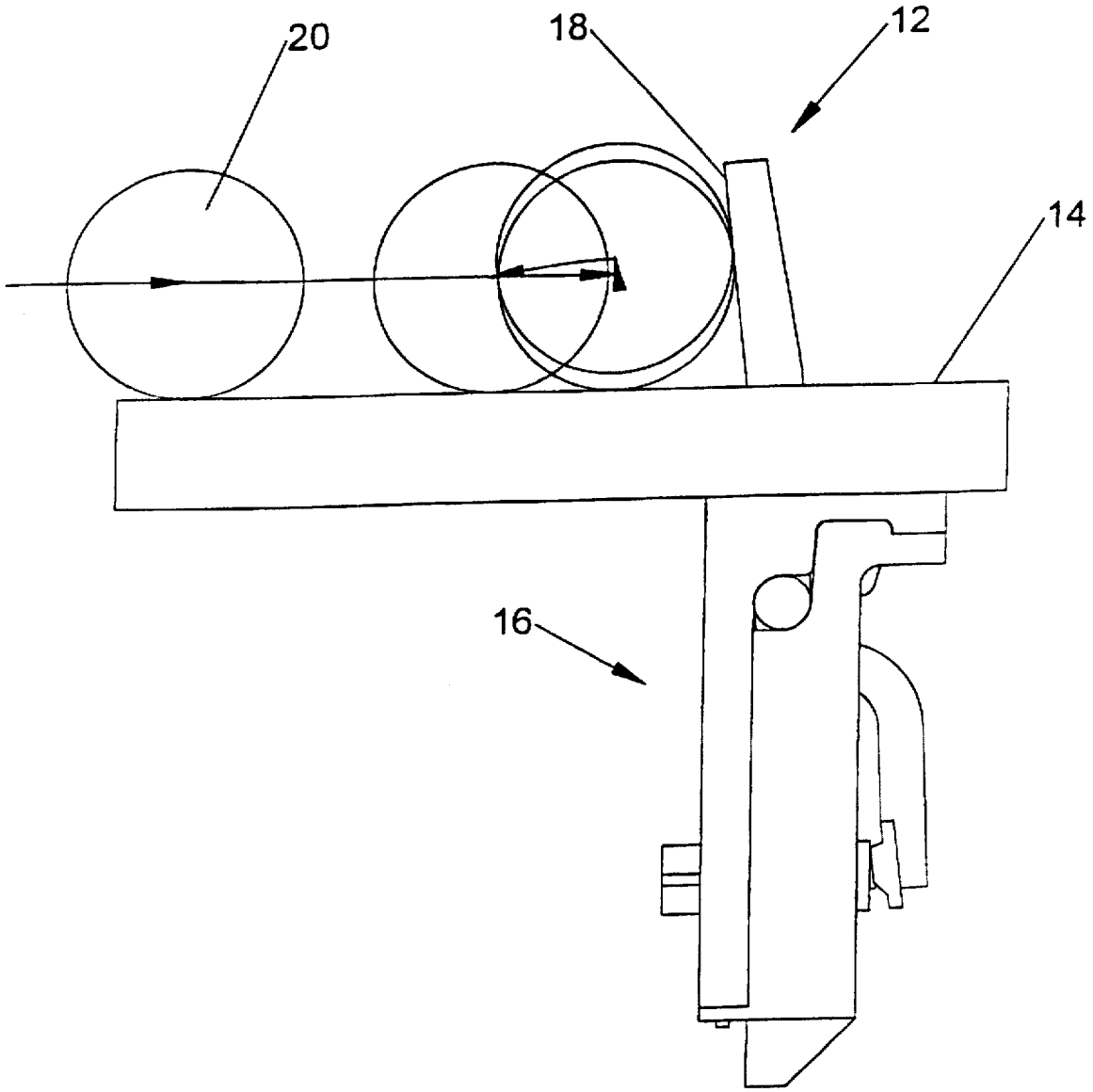
FIG. 13 is a side elevational view, similar to FIG. 12, showing the impact surface preselected angle being approximately 5° forward from the vertical.
Figure 14:
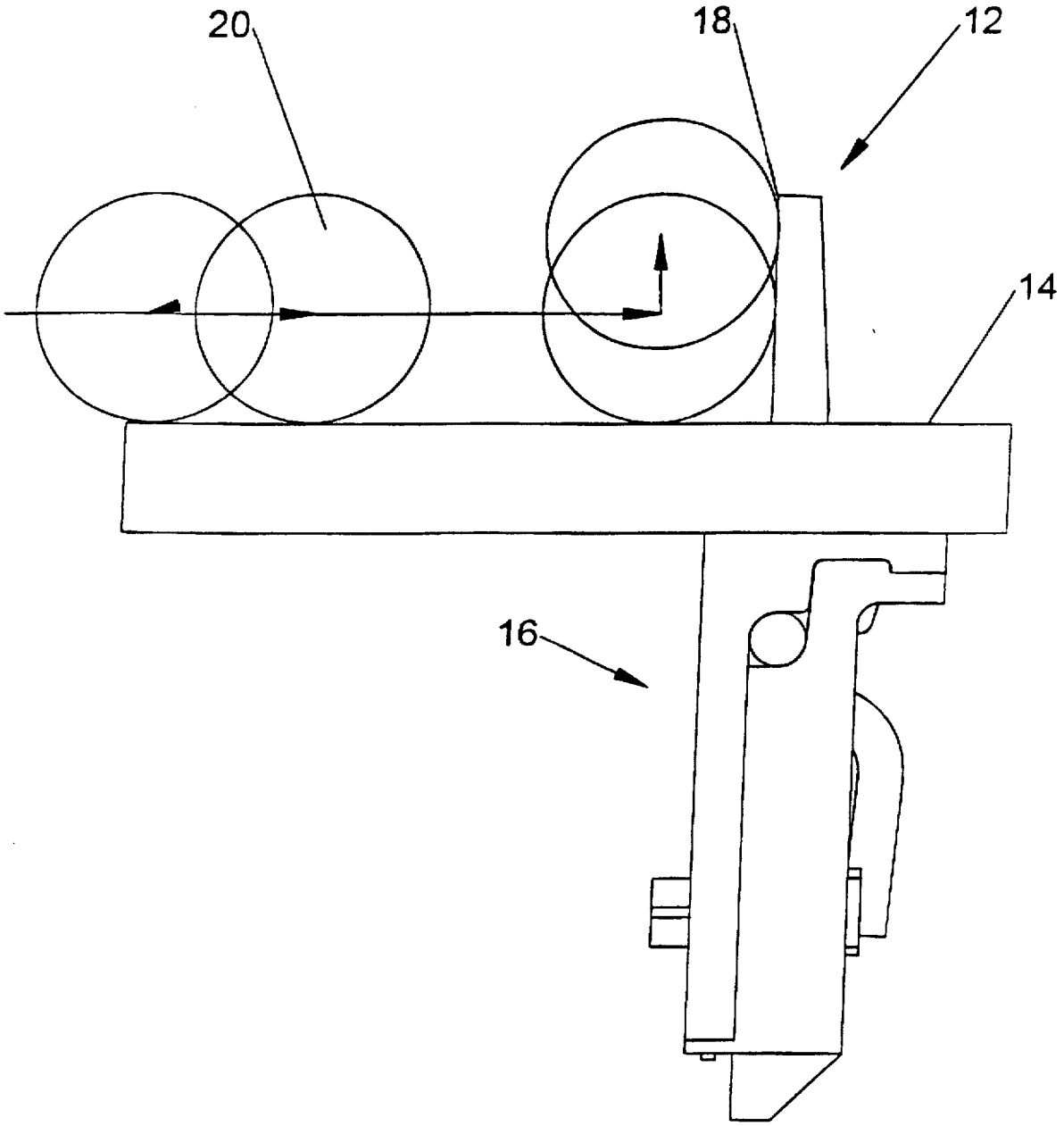
FIG. 14 is a side elevational view, similar to FIGS. 12 and 13, showing the impact receiving surface preselected angle of approximately 4° rearward from the vertical.

In mounting the prior art target heads, the connecting rivet protrudes through the target head such that a pinball, when engaging the prior target head, commonly struck the connecting rivet causing the pinball to rebound erratically in an unpredictable fashion therefrom. With the present unitary elongate member 28 and target head 12 thereof supported by reversible mount 16 below the playing surface 14, the entire extent of the impact receiving surface 18 is exposed for impacts from pinball 20. In this manner, the rebound of pinball 20 off of the impact receiving surface 18 occurs in a more predictable fashion and solely depends on factors such as the velocity and the approach angle of the pinball. As such, it is also possible to make the impact receiving surface 18 in a wide variety of configurations and shapes, such as the convex-shaped face 42 illustrated in FIGS. 18–21, and a wide variety of inclinations relative to the playing surface such as illustrated in FIGS. 12–14, while still controlling and being able to accurately predict the path of the pinball when rebounding from these impact surfaces 18 having predetermined shapes and inclinations.

While the entire surface of the convex face 42 is exposed to pinball contact without being interrupted by fasteners, unlike prior art face targets, the uneven, non-flat concave face 42 makes it more difficult to determine the path of pinball 20 after impacting the concave face 42 although such path is still predictable, again based primarily on the state of the pinball such as its velocity, spin, angle of approach and which portion of the convex face 42 is impacted, such that if these factors are equal, the rebound path of the pinball 20 will be consistently reproducible over repeated impacts. The pinball rebound path can also be controlled by forming the target head 12, and particularly the impact receiving surface 18, so that it extends from the housing mount 16 at a preselected angle relative to the playing surface 14. As seen in FIGS. 12–14, the greater the inclination of the impact surface 18 forward from the vertical with respect to the playing surface 14, the less the ball 20 tends to ride up on the target face 18 as it is moved back by the impact force of the pinball 20 thereagainst. Since the pinball 20 only rides up slightly on the target surface 18 as the forward incline is increased such as in FIG. 13, the target head 12, upon rebounding under the influence of the bias of the switch plunger 34, will propel the pinball substantially downward against the playing surface unlike the less angled target surface 18 in FIG. 12 or, for even greater ball lofting effects, the rearwardly angled surface 18 shown in FIG. 14, which tend to propel the ball 20 some distance before it lands back on the playing surface 14.

Figure 5:
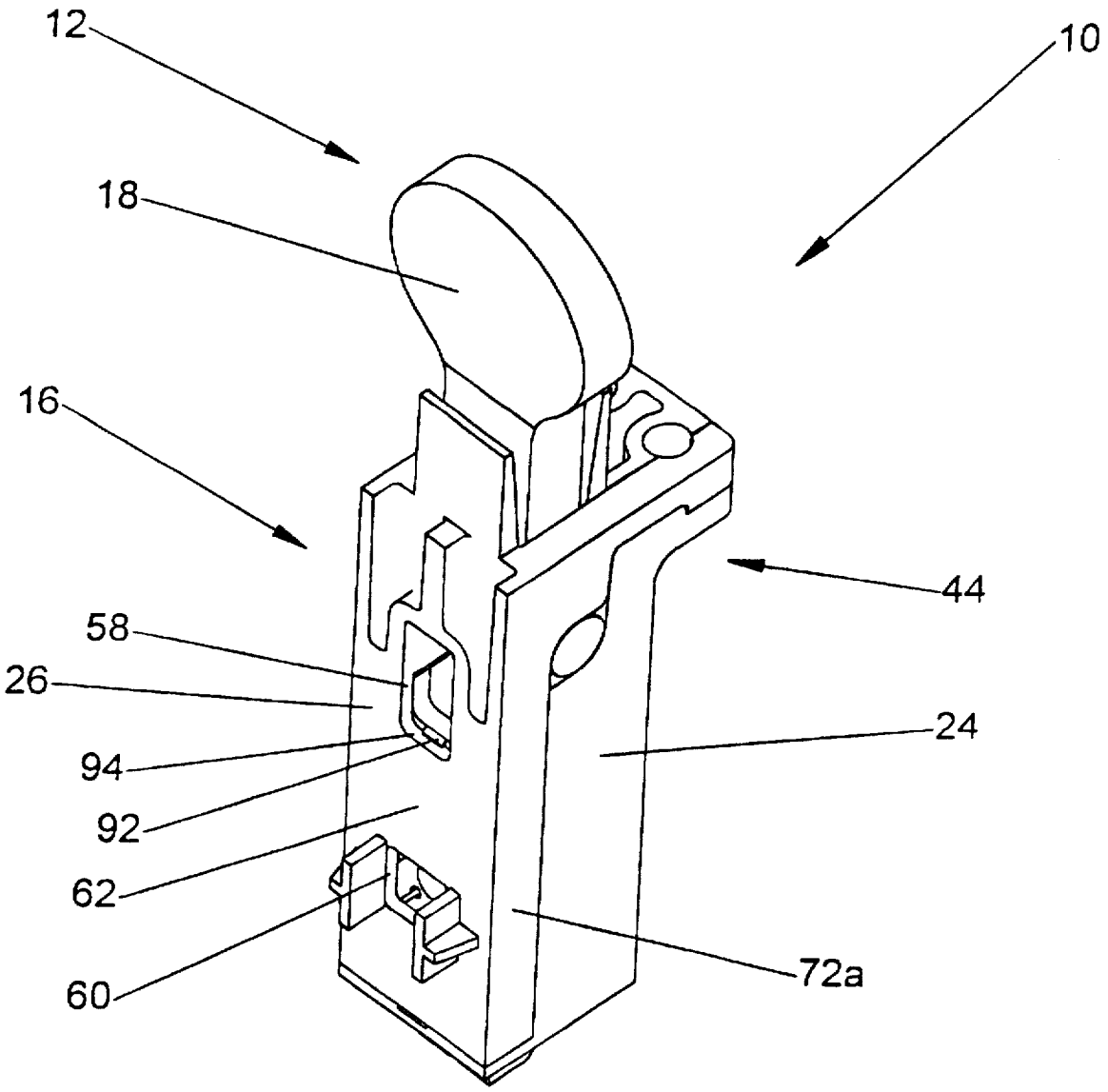
FIG. 5 is a perspective view of the target assembly of FIG. 1 assembled in its rear mount orientation.

FIGS. 5 and 6 show the reversible mount 16 switched to its rear mount orientation. As previously mentioned, the mount 16 can be reversed relative to the orientation of the target head 12 so that a transverse mounting portion 44 of the mount 16 extends either forwardly from the target head 12 as seen in FIG. 1 or rearwardly from the head 12 as seen in FIG. 5. In either case, the target 12 remains in the same orientation with only the mount housing members 24 and 26 reversed in their position relative to the target head orientation, and particularly the direction in which the impact surface 18 faces when the target assembly 10 is mounted in its operative position. In other words, in the front mount orientation, the first housing member 24 is the forward housing member and the second housing member 26 is the rear housing member; for the rear mount, the first housing member 24 is the rear housing member and the second housing member 26 is the front housing member. As the housing members 24 and 26 are removably connected to each other and do not use distinct fastening members, such as screws or rivets, to achieve their connection, the housing members 24 and 26 also can be easily separated from each other to be switched from one of the forward and reverse mount orientations to the other.

The design of the housing members 24 and 26 is such that in either the front or rear mount orientations, the housing members 24 and 26 cooperate to capture the intermediate portion 30 of the elongate member 28 with the target head impact receiving surface 18 facing in the same direction. This provides the pinball machine designer with greater flexibility in that, depending on the space requirements for other parts that are mounted on or underneath the playing surface, the mount 16 can be placed in either one of its front or rear orientations to readily accommodate for these other parts and thus a wider variety of pinball game designs. In addition, as the mounts 24 and 26 can be easily taken apart and separated from one another after being assembled together, as more fully described herein, and then reversed relative to each other and the target head 12 and put back together, the mount 16 can be changed after the game has been assembled to accommodate for any subsequent design changes that may be necessary or desired without having to substitute a whole new target assembly as with the prior leaf spring type target assemblies which have their mounting bracket permanently riveted in either its front or rear mount orientation.

More specifically and referring again to FIGS. 1–6, the unitary elongate member 28 can include the target head 12 which, as shown, has a generally circular shape with adjoining flats therearound, an elongate bar portion 46 depending from the target head 12, the intermediate pivot portion 30 and a switch actuator or lever arm 48 depending from the intermediate portion 30. The intermediate pivot portion 30 is in the form of a pivot shaft 50 which extends between and transversely to the elongate bar portion 46 and the lever arm 48. The first housing member 24 has a lower bearing surface 52 on which the pivot shaft 50 is supported for pivoting movement. In the preferred form, both the unitary elongate member 28, including the pivot shaft 50 and the housing members 24 and 26 including the bearing surface 52 of the first member 24 are formed from plastic materials having a low coefficient of friction so that the pivoting action of the shaft 50 on the bearing surface 52 is facilitated and relatively smooth with only some of the energy from the pinball impact on the target head 12 absorbed by the friction between the shaft 50 and the bearing surface 52 as the shaft 50 pivots thereon.

To capture the pivot shaft 50 in engagement on the bearing surface 52, the second housing member 26 has a pair of upper arcuate shoulder surfaces **54*a* and 54*b*. The second housing member 26 can be connected to the first housing member 24 such that the shoulder surfaces 54 cooperate with the bearing surface 52 to define a seat area 55 for the pivot shaft 50 to capture the pivot shaft 50 therein between the upper shoulder surfaces 54 and lower bearing surface 52** for smooth pivoting thereagainst.

In the illustrated and preferred form, the lower end 40 of the lever arm 48 has a foot projection 56 which is adapted to engage the switch activation plunger 34 exteriorly of the reversible housing mount 16. For such exterior engagement, the reversible housing mount 16 has a pair of openings formed in each of the housing members 24 and 26 to accommodate the lever arm 48 and switch plunger 34 in both its front and rear mount orientations. More specifically and referring to the front mount orientation, the second housing member 26 has an upper window opening 58 and a lower window opening 60 formed in its main vertical wall 62. The lever arm 48 preferably has an S-shaped horizontal portion 64 extending from the pivot shaft 50 and leading to a straight vertical portion 66 having the foot projection 56 at its lower end 40. The main vertical wall 62 has a pair of vertical flanges **68*a* and 68*b* extending outwardly at right angles from the vertical wall 62 on either side of the lower window opening 60 between which the foot projection 56 and activation plunger 34** are engaged.

For shipping and handling purposes, it is desirable to connect the housing members 24 and 26 with their component parts mounted therein, i.e., elongate member 28 and switch device 32. To mount the unitary elongate member 28 in the reversible housing mount 16 in its front mount orientation, the lever arm 48 is inserted through the upper window opening 58 so that the pivot shaft 50 is adjacent the shoulder surfaces 54 with the S-shaped portion 64 extending generally horizontally through the window 58 so that the straight portion 66 extends vertically downward with the foot projection 56 between the side flanges 68 of the lower window 60. The switch 32 and printed circuit board 38 are mounted in the bottom of the reversible housing mount 16 with the switch housing 36 between the board 38 and the main vertical wall 62 such that the activation plunger 34 projects through the lower window 60 between the flanges 68 into engagement with the foot projection 56 thereat.

To connect the housing members 24 and 26 for capturing the pivot shaft 50 with the lever arm 48 in position to activate the switch 32 and the target head 12 in place above the playing surface 14 in position to be contacted by pinball 20, the housing members 24 and 26 are provided with structure for releasably connecting the two together. To orient the elongate member 28 vertically in the housing mount 16, and particularly the elongate bar portion 46, the second housing member has a pair of facing upper guide surfaces **70*a* and 70*b* extending vertically upward from the inner side of the respective arcuate shoulder surfaces 54*a* and 54*b*, as best seen in FIG. 4. The spacing between the guide surfaces 70*a* and 70*b* can be only slightly greater than the distance across the elongate bar portion 46 so that with the mount 16 supporting the elongate member 28, the guide surfaces 70*a* and 70*b* maintain the elongate bar portion 76** extending vertically upward therebetween.

The main vertical wall 62 extends between two inverted generally L-shaped sidewall portions **72*a* and 72*b* with each including respective inner track members 74*a* and 74*b* extending laterally towards each other and vertically upward from approximately midway along their respective sidewall portions 72*a* and 72*b* to the arcuate shoulder surfaces 54*a* and 54*b*, respectively. Elongate guide members 76*a* and 76*b* are provided on the inner side of the L-shaped sidewall portions 72*a* and 72*b* and extend upward from the bottom of the sidewalls 72 and underneath the track members 74*a* and 74*b* which overhang inwardly from the guide members 76 to form a guideway track 77 for a flanged lock member 78 formed on the first housing member 24**.

The flanged lock member 78, as best seen in FIG. 6, includes a flat U-shaped portion 80 spaced by spacer walls **82*a* and 82*b* from upper partition walls 84*a* and 84*b* of the first housing member 24. The U-shaped portion 80 has flange leg portions 86*a* and 86*b* thereof which extend at right angles outward from their respective spacer walls 82*a* and 82*b*. The flanged lock member 78 has a sturdy, rigid construction as described above to provide for secure sliding in track 77 and a tight locking arrangement between the housing members 24 and 26**.

The distance across the flange leg portions **86*a* and 86*b* substantially corresponds with the distance between the inner sides of the guide members 76*a* and 76*b* so that the members 76 guide the U-shaped portion 80 as it is slid vertically along the inner side of the main vertical wall 62. Continued upward sliding of the flange lock member 78 and its U-shaped portion 80 causes the leg portions 86 to move under the overhanging portions of the track forming members 74 into the track 77 formed thereby. A wedge-shaped cam lock member 92 is provided on the bight of the U-shaped portion 80 with the cam member 92 camming against the inner side of the relatively thin wall 62 spanning the sidewalls 72 to slightly flex the wall 62 outwardly as the U-shaped portion 80 slides in its track 77. It is also possible for the cam member 92 to be formed so that it is resiliently cammed into the space 106 between the U-shaped member leg portions 86 as the leg portions 86 are slid in the track without any deflection of the main wall 62**.

Figure 8:
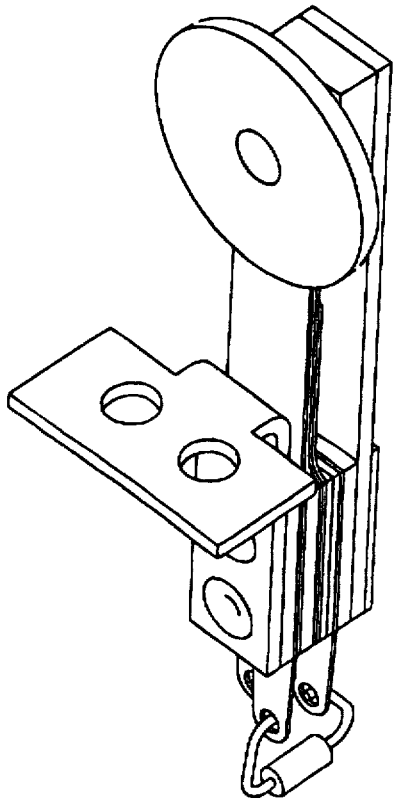
FIG. 8 is a perspective view of a prior art leaf spring type front mount face target assembly.
Figure 9:
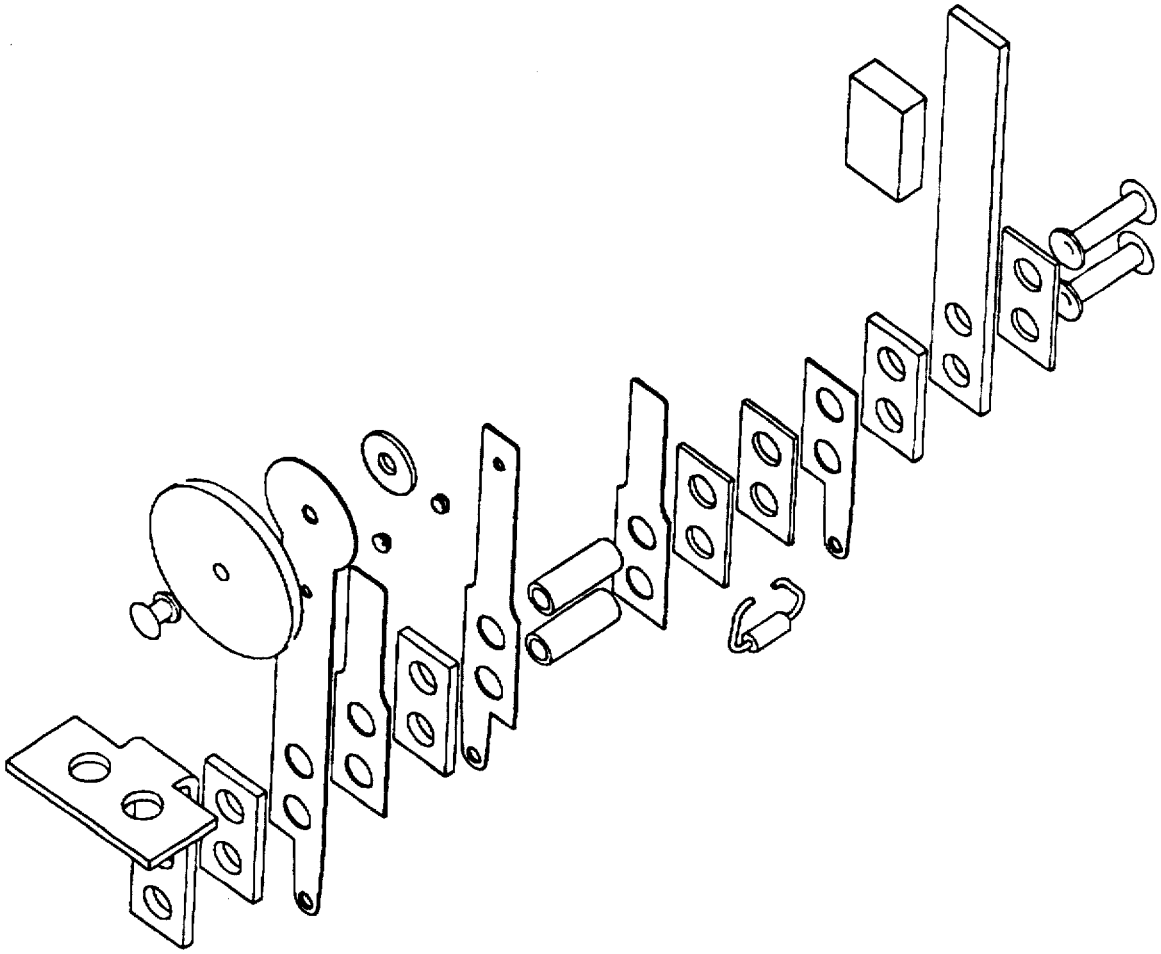
FIG. 9 is an exploded view of the prior art face target assembly of FIG. 8.

The guide members 76*a* and 76*b* can extend slightly beyond the lower end of the vertical wall 62 and sidewall portions 72 and the first housing member 24 can have a bottom wall 88 having a pair of locating apertures 90*a* and 90*b* into and through which the bottom of the respective rail members 76*a* and 76*b* can extend when the flange lock member 78 is extended upward to connect the housing members 24 and 26 into releasably locked assembly with each other with the pivot shaft 50 captured in the seat area 55. In this position, the cam member 92 will move into latching engagement with the bottom side 94 of the upper window 58 locking the housing members 24 and 26 together to prevent housing member 24 from being slid downward relative to housing member 26 with the bottoms of the walls 62 and 72 of the second housing member 26 abutting the first housing member bottom wall 88 to prevent housing member 24 from being slid further upward relative to housing member 26. Alternatively, with the cam member 92 formed so as to resiliently move into space 106 during track sliding of legs 86, the cam lock member 92 on the bight of the U-shaped portion 80 will rebound out of the space 106 back to its original non-bent orientation to latch onto the bottom side 94 of the upper window 58 locking the first and second housing members 24 and 26 together as with the wall flexing lock member 92. As apparent from the above, the inventive target assembly 10 herein utilizes a greatly reduced number of parts versus the prior target assemblies as illustrated in FIGS. 8 and 9 as it does away with the various leaf spring members and rivet connections therefor. As a result of this and the lack of riveted connections, the assembly of the target assembly 10, with the flanged lock member 78 on housing member 24 and track 77 therefor on housing member 26 and the latch locking arrangement provided between the two housing members 24 and 26, is faster and vastly simplified.

The front mount orientation illustrated in FIGS. 1–4 is the preferred commercial form of a mount for a non-driven face target assembly as with the leaf spring type assemblies described in the background and illustrated in FIGS. 8 and 9 and, accordingly, is also preferred for the target assemblies 10 herein. However, it may be desirable, depending upon the specific design considerations at hand for a particular pinball game, to be able to reverse the mounting arrangements for these target assemblies, both before and after installing these target assemblies 10 in a pinball game. So, for example, with the target assemblies 10 assembled in their front mount orientation, it may be desirable to be able to disassemble the target assembly 10 to reverse the mounting orientation so that the target assembly 10 has its rear mount orientation, as best seen in FIG. 5. With the present target assemblies 10 utilizing the removably connected housing members 24 and 26, such housing mount reversal can be readily provided for and accomplished as described below.

To provide for housing mount reversal from the previously-described front mount orientation to the rear mount orientation, the first housing member 24 has an upper opening or slot 96 formed between the partition walls 84*a* and 84*b*. An intermediate wall 98 extends horizontally at the bottom of the partition walls 84 below the flanged lock member 78. A lower vertical wall 100 extends downward from the outer edge of the intermediate wall 98 to the outer edge of the bottom wall 88 oriented at right angles to the vertical partition walls 84. The lower vertical wall 100 has a lower window 102 formed therein. Sidewall portions 104*a* and 104*b* extend vertically along either side of the lower vertical wall 100 with the intermediate wall 98 spanning the sidewalls 104. The sidewalls 104 extend upward beyond the intermediate wall 98 and the lower vertical wall 100 parallel to the partition walls 84*a* and 84*b* with the partition walls 84*a* and 84*b* spaced inwardly therefrom. The width of the sidewalls 104 does not extend the full extent of the sides of the bottom wall 88 so that the bottom wall 88 has an exposed portion 105 on either side of which are the locating apertures 90. The exposed portion 105 limits the upward sliding of the housing member 24 relative to housing member 26 during assembly of the two together by its engagement with the bottoms of the housing member walls 62 and 72, as previously described.

To mount the target assembly 10 with its rear mount orientation and referring to FIGS. 5 and 6, the foot projection 56 of the elongate member 28 is inserted through the space 106 between the leg portions 86 of the flange lock member 78 and then further through the slot 96 between the partition walls 84. In this manner, the pivot shaft 50 can be positioned on the support bearing surface 52 with the S-shaped portion 64 of the lever arm 48 extending generally horizontally between the partition walls 84 and through the slot 96 defined therebetween with the vertical portion 66 of the lever arm 48 extending downward so that at its lower end 40, the foot projection 56 is adjacent the lower window opening 102 of the first housing member 24. With the elongate member 28 so positioned, the flanged lock member 78 on the first housing member 24 can be slid into the track 77 formed on the second housing member 26 to releasably lock the two housing members 24 and 26 together, as previously described with respect to the front mount orientation thereof.

To reverse the housing member orientation relative to the target head 12 after the target assembly 10 has been assembled, the housing members 24 and 26 can be separated by prying and breaking the relatively small, wedge-shaped lock member 92 off of the U-shaped portion 80 to allow the first housing member to be slid downwardly with respect to the second housing member 26 thereby allowing the unitary elongate member 28 to be removed and the housing members 24 and 26 reversed relative thereto. Once the housing members 24 and 26 have been reversed, they can be maintained in that assembled state by fastening members for attaching the target assembly 10 in its operative position in a pinball machine as the fastening members will extend through the mounting portion 44 and clamp the members 24 and 26 together, as more fully described herein. As previously mentioned, it is also contemplated that the cam lock member 92 may be designed so that it can resiliently bend. In this manner, upon exertion of a sufficient sliding separation force between the housing members 24 and 26 to slide them oppositely as described above, the resilient cam lock member 92 will cam over the window bottom wall 94 and against the inner side of the main vertical wall 62 of the second housing member to allow the housing members 24 and 26 to be separated from one another.

With the housing members 24 and 26 assembled to capture the pivot shaft 50 in the seat 55 therefor, another important aspect of the present invention is the containment of the switch device 32 in the housing mount 16. With the housing members 24 and 26 releasably locked together, as described above, the side wall portions 104*a* and 104*b* of the first housing member cooperate with the sidewall portions 72*a* and 72*b* of the second housing member 26, respectively, to form sides of a switch chamber 108 defined in the lower region of the housing member 16. The top and bottom of the switch chamber 108 are formed by the intermediate wall 98 and the bottom wall 88, respectively, with the front and back of the switch chamber 108 formed by the lower region 62a of the main vertical wall 62 of the second housing member and the lower vertical wall 100 of the first housing member, with these vertical walls capable of being changed between the front and the back depending on the orientation of the transverse mounting portion 44 in the rear mount or front mount orientation.

Preferably, the distance across the side walls of the switch chamber 108 is only slightly greater than the width of the printed circuit board 38 and the distance between the top and bottom of the switch chamber 108 is only slightly greater than the height of the circuit board 38 so that it is tightly received in a vertical orientation in the switch chamber 108 with the edges of the board 38 engaging the inside of the walls of the chamber 108. The microswitch 32 is mounted to the circuit board 38 with the plunger 34 extending substantially horizontally at right angles therefrom. A pair of electrically connected lead pins 110a and 110b are attached to the circuit board at one end and depend downwardly from the board 38 with pinholes 112a and 112b provided substantially centrally in the bottom wall 88. In this manner, the lead pins 110 can extend through their holes 112 with the switch housing 36 mounted between the printed circuit board 38 and either one of the front and back vertical walls of the switch chamber 108 such as lower vertical wall portion 62a when the target assembly 10 is in its front mount orientation or vertical wall 100 when the target assembly 10 is in its rear mount orientation.

Referring again to FIGS. 10 and 11, the front mount target assembly 10 is illustrated in its operative position with the target head 12 supported by the housing mount 16 ready to receive a pinball impact. In this position, the connector lead pins 110 extend downwardly through the bottom wall 88 of the first housing member 24 with the bottom wall 88 having electrical connector capturing structure 116 formed adjacent the pinholes 112 and extending downwardly from the wall 88 adjacent the connector lead pins 110. The connector capturing structure 116 is adapted to capture a conventional socket head 118 for pinball lead wires 120, as best seen in FIGS. 22 and 23.

The capturing structure 116 has a ledge surface 120 spaced from the bottom of the bottom wall 88. The socket head 118 has a pair of connector pin sockets (not shown) formed in its upper surface 122 and an intermediate step surface 124 spaced below the upper surface 122 with the spacing between the upper surface 122 and step surface 124 substantially corresponding to the distance between the bottom of the wall 88 and the ledge surface 120. In this manner, the connector pins 110 can be inserted in the sockets of the socket head 118, with the socket head 118 being pushed towards the bottom wall 88 until the socket head upper surface 122 abuts the bottom of the bottom wall 88 with the step surface 124 in confronting relation with the ledge surface 120 so as to prevent accidental withdrawal of the socket head 118 from the connector pins 110 and corresponding electrical isolation of the target assembly 10. With the connector pins 110 plugged into the socket head 118, the target assembly 10 can be electrically connected, for example, to the game microprocessor by one of the socket head leads 126a and by a common lead line 126b to the remainder of the targets in an array.

Figure 22:
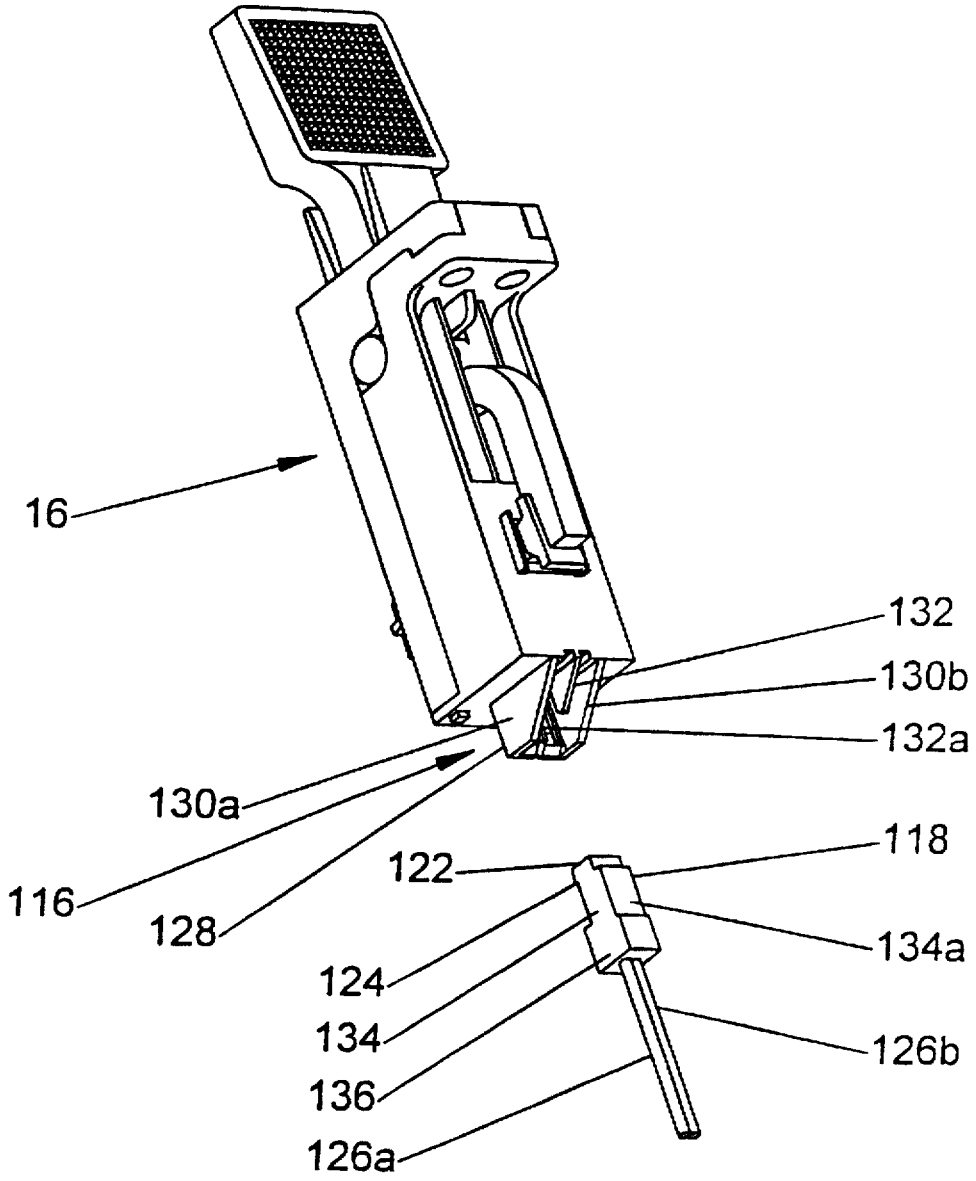
FIG. 22 is a rear perspective view of the target assembly in its rear mount orientation showing a detached electrical connector with the target assembly having a modified lower connector capturing structure.
Figure 23:
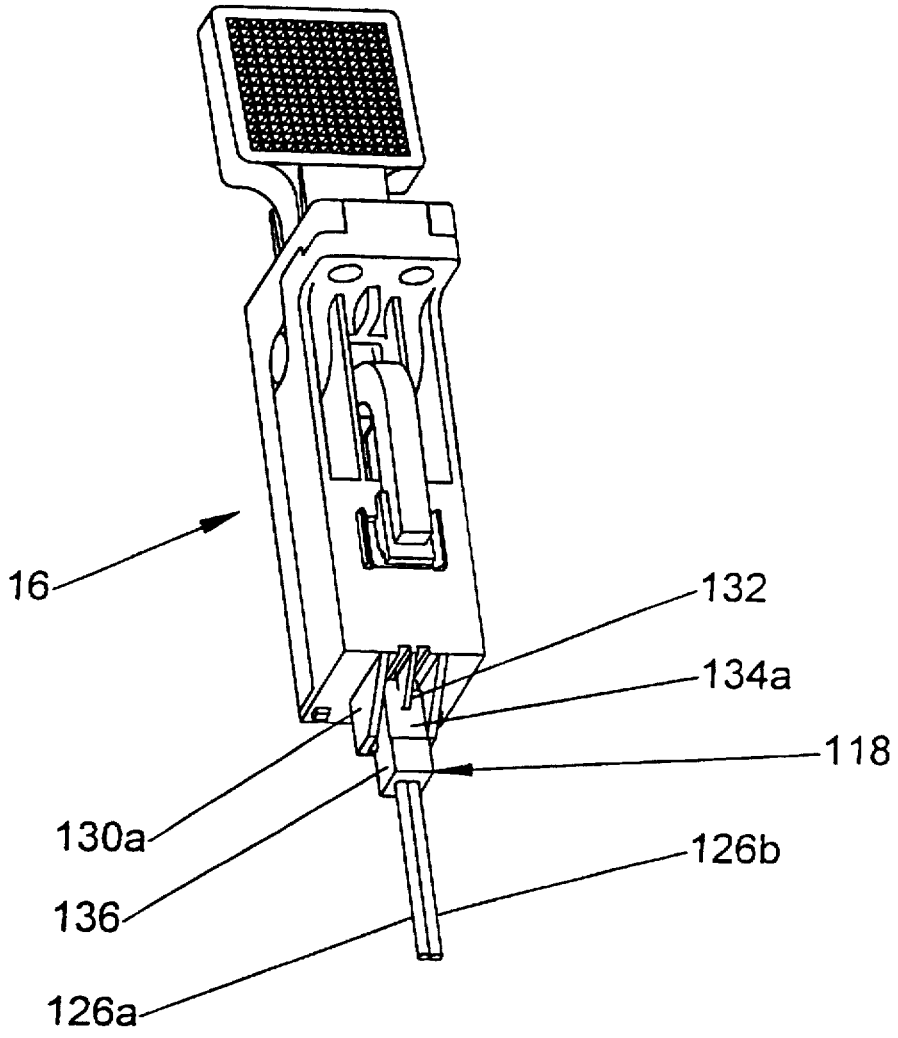
FIG. 23 is a perspective view of the rear mount target assembly, similar to FIG. 22, with the electrical connector captured by the lower capturing structure.

The preferred form of connector capturing structure 116 is illustrated in FIGS. 22 and 23. In the preferred form, the ledge surface 120 is provided extending from a rear vertical wall 128 depending from the bottom wall 88 with side shielding walls 130a and 130b extending forwardly from the rear wall 128 on either side thereof. The rear wall 128 along with the sidewalls 130 serve to protect the connector pins 110 as they extend through the pinholes 112 provided in the bottom wall 88 during shipping and handling of the target assemblies 10. In addition, the walls 128 and 130 shield the interface between the socket head 118 and connector pins 112 from the environment when the target assemblies 10 are placed in their operative state in a pinball machine.

To securely maintain the connection between the connector pins 110 inserted in the socket head 118 with the ledge surface 120 and step surface 124 in confronting relation, a triangular-shaped locating member 132 is provided between the sidewalls 130a and 130b spaced forwardly from the rear vertical wall 128. The socket head 118 has an intermediate narrow portion 134 extending downwardly from the step surface 124 to an enlarged base portion 136 from which the lead wires 126 extend. The rear 132a of the locating member 132 is spaced forwardly from the rear wall 28 at a distance slightly greater than the width of the socket head narrowed portion 134. Thus, with the connector pins 110 inserted in the socket head apertures and with the top surface 122 abutting the bottom of the wall 88, the rear 132a of the locating member 132 will engage the front flat surface 134a of the narrowed portion 134 to capture the socket head 118 in the capturing structure 116 and limit lateral movement of the step surface 124 relative to the ledge surface 120. In this arrangement, the base portion 136 is the only part of the socket head 118 that extends beyond the lower end of the walls 128 and 130, as best seen in FIG. 23.

Returning again to FIGS. 10–14, the action of a pinball 20 when impacting against and rebounding from a target head 12 is illustrated along with the pivoting action of the unitary elongate member 28. FIG. 10 illustrates the impact surface 18 in its pre-impact position, slightly angled forward at approximately 5° with respect to a line normal with the playing surface 14. To pivot the target head 12 to this position, the lower end 40 of the unitary elongate member 28 is biased by the bias force exerted on the activation plunger 34 by a compression spring (not shown) mounted in the switch housing 36 to urge the switch plunger 34 exteriorly thereof. With the lower end 40 biased in one direction, the unitary elongate member 28 pivots about its intermediate pivot portion 30 so as to move the target head opposite to the first bias direction of the lower end 40.

Of course, as previously described, the inclination of the target face 18 can be varied during manufacture of the elongate member 28 depending upon the lofting action of the pinball 20 desired. Referring to FIG. 11, as the pinball 20 impacts the target face 18, target head 12 moves from its predetermined pre-impact position above the playing surface (FIG. 10) rearwardly pivoting the elongate member 28 about the intermediate portion 30 causing the lower end 40 to depress the plunger 34 against the bias of its compression spring and thereby closing the switch circuit to send a signal to the game microprocessor indicating a scoring hit on the target face 18 and/or activating other game features in the pinball game.

After the target head 12 has reached its limit of rearward travel, the pinball 20 starts to ride-up the impact surface 18, as shown in FIG. 12. The amount of such pinball ride-up is influenced by the speed at which the pinball 20 hits the impact surface as well as the inclination of the impact surface 18 relative to the playing surface 14. As can be seen in FIG. 14, with all other factors regarding pinball travel being equal, the greater the inclination rearward from the normal line relative to the playing surface 14, the greater the amount of pinball ride-up on the impact surface 18.

Once the target 12 has reached its rearmost position over the playing surface 14, the target head 12 will be biased back to its pre-impact position over the playing surface 14 under the influence of the bias force on the activation plunger 34 thereby propelling the ball 20 back away from the target head 12. Again, the path the ball 20 takes upon rebounding from the target head 12 is greatly influenced by the amount of ride-up of the pinball 20 on the target face 18 and, therefore, the inclination of the target face 18 relative to the playing surface 14. With the impact surface 18 at a greater forward inclination with respect to the normal line as in FIG. 13 with a 5° forward angle from the normal line, the ball will only ride-up the target face 18 slightly and will be directed almost directly downward against the playing surface 14 in front of the target head 12. On the other hand, with the face surface 18 rearwardly angled as shown in FIG. 14, the return action of the target head to its pre-impact position will cause the pinball 20 to be lofted away from the target head 12 some distance before landing back on the playing surface 14.

Figure 16:
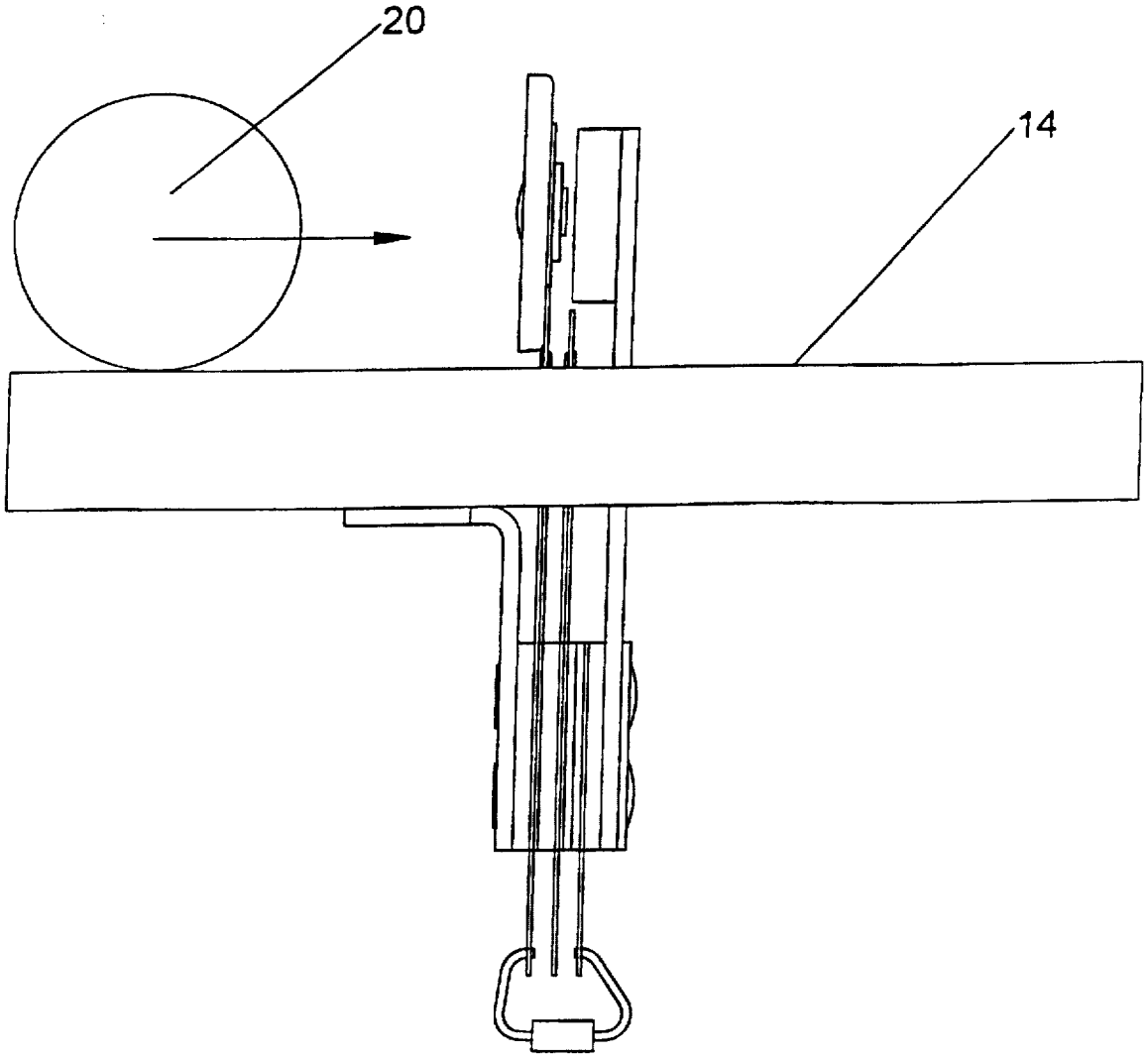
FIG. 16 is a side elevational view of the prior art front mount face target assembly of FIGS. 8 and 9 mounted to a pinball playing surface before being impacted by a pinball.
Figure 17:
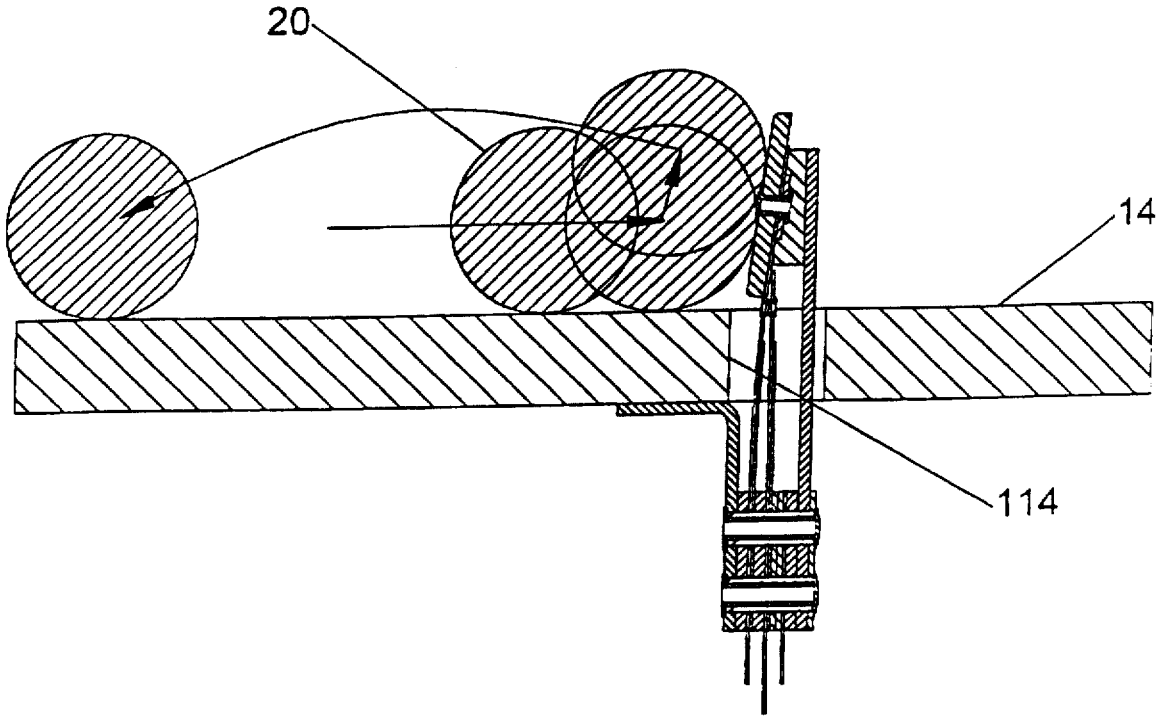
FIG. 17 is a sectional side elevational view of the prior art front mount face target assembly being impacted by the pinball and its path upon rebounding from the target.
Figure 18:
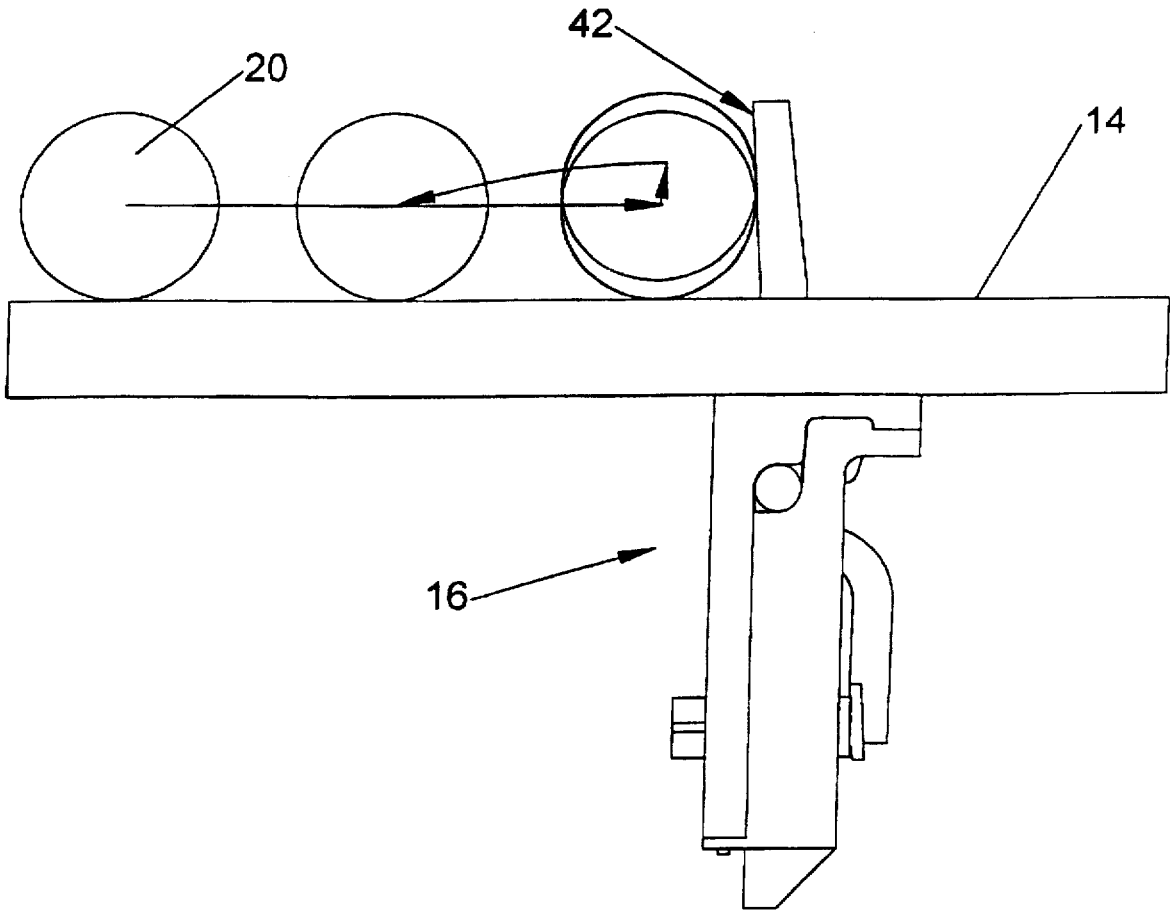
FIG. 18 is a side elevational view of the rear mount target assembly according to the present invention having a convexly shaped impact receiving surface and showing a pinball impacting and rebounding therefrom.
Figure 19:
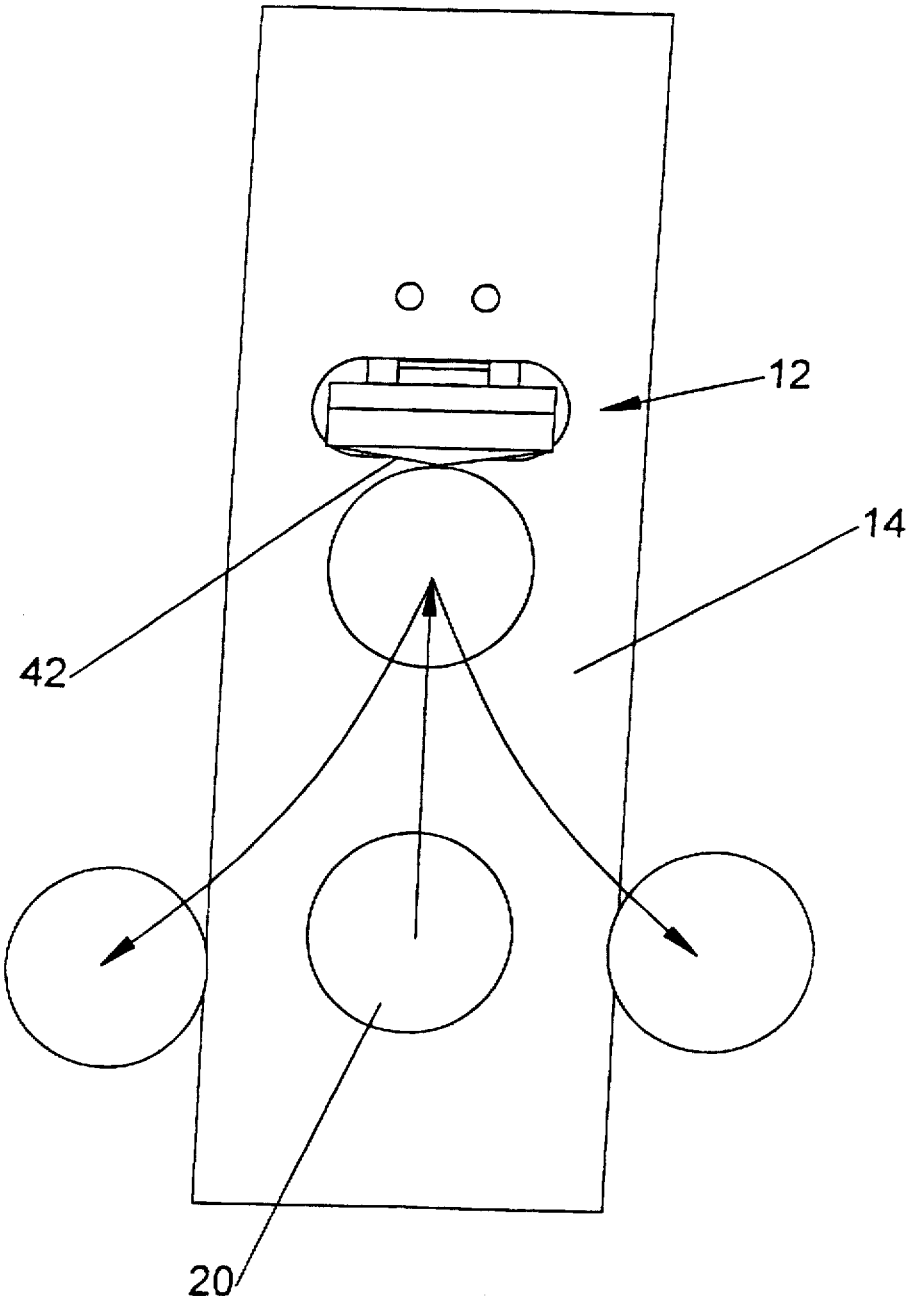
FIG. 19 is a top plan view of the target assembly of FIG. 18 showing potential pinball paths after straight-on impact with the convex impact receiving face.
Figure 20:
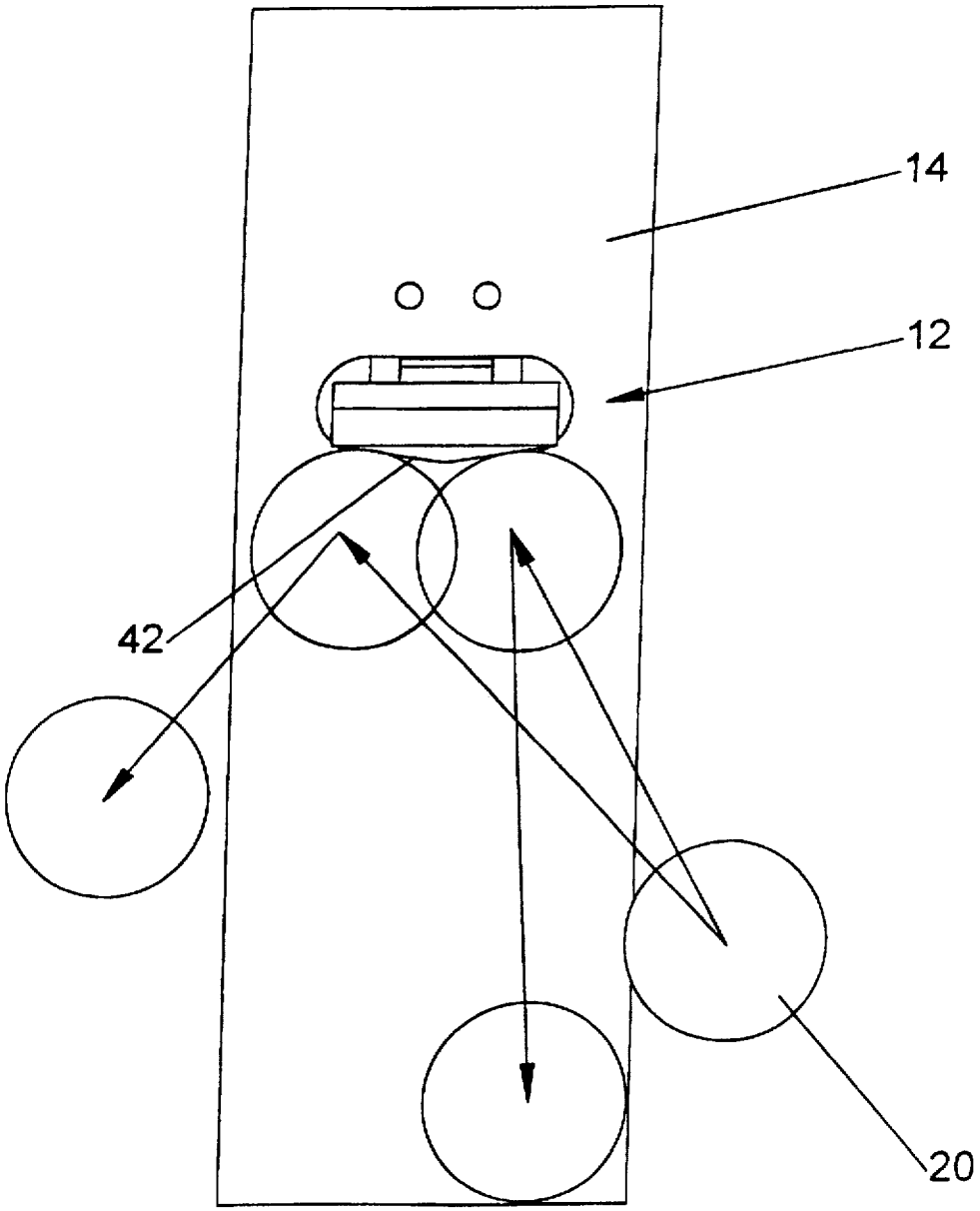
FIG. 20 is a top plan view, similar to FIG. 19, showing potential pinball paths after impacting the convex impact surface from one side of the target head.
Figure 21:
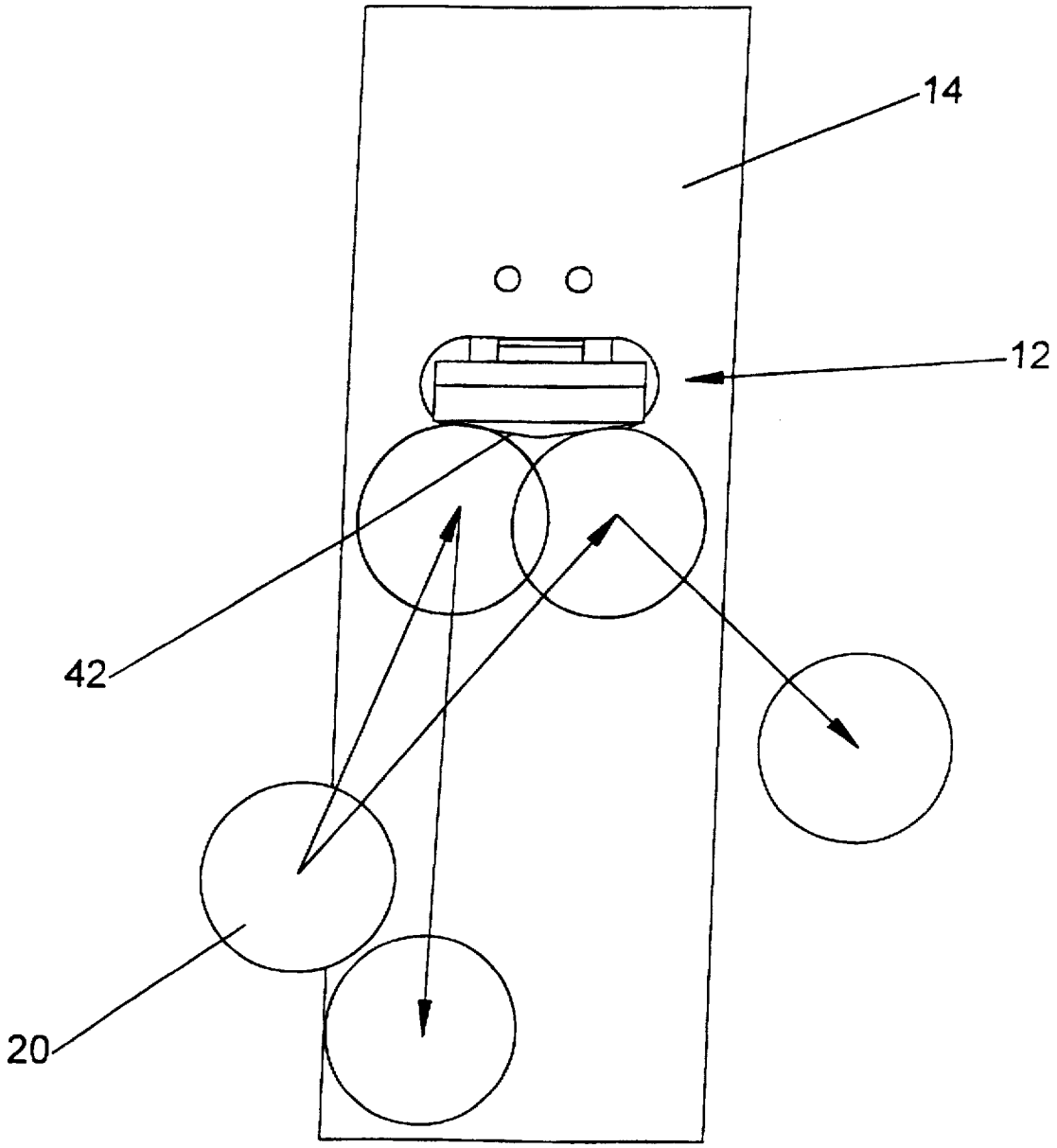
FIG. 21 is a top plan view, similar to FIG. 19, showing potential pinball paths after impacting the convex impact surface from the other side of the target head.

As the target assembly 10 herein avoids the use of leaf spring members which fatigue over repeated cycling, the present target assemblies 10 allow pinball ride-up and lofting effects to be more accurately controlled even over a prolonged period of usage. With the prior face target assemblies as shown in FIGS. 16 and 17, the corresponding target face 18 was generally mounted to be perpendicular to the playing surface, although after repeated impacts and prolonged use, the target head tended to change its orientation relative to the playing Surface 14 and, accordingly, varying the ride-up and lofting effects on a pinball 20 over time. In any event, as these prior target assemblies were limited in their impact surface orientations by the vertical leaf spring support members utilized, the rebound path of a pinball 20 impacting such a target head is not readily changeable. By contrast, the construction of the target assemblies 10 herein allows for the target head 12 to be molded so that the impact face 18 can have a wide range of inclinations relative to the playing surface 14.

To mount the target assemblies 10 in a pinball machine, the mounting portion 44 has a pair of apertured bosses 137*a* and 137*b* formed therein, as best seen in FIG. 1. To form the mounting portion 44 and more specifically bosses 137, the first housing member 24 has a horizontal shelf portion 138 extending substantially at right angles from the partition walls 84 and the sidewalls 104, as seen in FIG. 4. The shelf portion 138 has a raised central portion 140 having a pair of oppositely outward facing arcuate surfaces 142*a* and 142*b* having a laterally extending front raised wall portion 143 extending between and outwardly from the surfaces 142. The sidewalls 72*a* and 72*b* of the second housing member 26 include respective leg extensions 144*a* and 144*b* extending generally at right angles to the main vertical wall 62 outward from the upper guide surfaces 70 and arcuate shoulder surfaces 54. The leg extensions 144*a* and 144*b* include respective facing arcuate surfaces 146*a* and 146*b* formed near their distal ends with the spacing between the ends substantially corresponding to the distance across the raised lateral wall portion 143. Both the arcuate surfaces 142*a* and 142*b* of the raised central portion and the arcuate surfaces 146*a* and 146*b* of the leg extensions 144 extend in a semicircular shape in profile such that when the housing members 124 and 126 are releasably locked together, the arcuate surfaces 142*a* and 142*b* cooperate with the corresponding arcuate surfaces 146*a* and 146*b* to define the apertures of the cylindrical apertured bosses 137*a* and 137*b*.

In addition to the bottom wall portion 105 to limit the upward sliding movement of the first housing member 24 relative to the second housing member 26 when sliding the flanged lock member 78 in its track 77 to assemble the housing members 24 and 26 together, the first housing member shelf portion 138 has channel seats 148*a* and 148*b* defined on either side thereof, as best seen in FIGS. 4 and 6. The arm extensions 144 of the second housing member 26 include cut-out portions 150*a* and 150*b* to allow the arm extension 144 to cooperate with the channel seats 148 to provide for tight fitting abutting engagement of the arm extensions 144 with the sides of the shelf portion 138 when the housing members 24 and 26 are releasably locked together.

More specifically, the shelf portion 138 of the first housing member 24 has slightly raised outer side portions 152*a* and 152*b* below the top surfaces of the raised central portion 140 and adjacent lower surfaces 154*a* and 154*b* on either side of the raised central portion 140. The lower surfaces 154*a* and 154*b* extend beyond the raised side portions 152*a* and 152*b* to form lowered corner surfaces 156*a* and 156*b* adjacent corresponding arcuate surfaces 142*a* and 142*b*. The raised side portions 152 and adjacent lower surfaces 154 cooperate to define the channel seats 148*a* and 148*b* of the shelf portion 138. The cut-outs 150*a* and 150*b* of the arm extensions 144*a* and 144*b* define narrowed portions 158*a* and 158*b* which are sized to tightly seat within the channel seats 148*a* and 148*b* between the sides of the central portion 140 and the raised side portions 152 abutting the lower surfaces 148*a* and 148*b* with the distal ends of the arm extensions 144*a* and 144*b* seating on the corner surfaces 156*a* and 156*b*. With the narrowed portion 158 seated in the channel seats 148, the top of the raised central portion 140 will be flush with the top of the arm extensions 144 with the raised lateral wall portion 143 tightly fitting between the ends of the leg extensions 144. In this manner, the abutment of the leg extensions 144 and the shelf portion 138 caused by releasably locking the two housing members 24 and 26 together forms the transverse mounting portion 44 with the apertured bosses 137.

Thus, with the housing members 24 and 26 releasably locked together, the cam lock member 92 prevents the first housing member 24 from sliding downward with respect to the second housing member 26 while the abutment of the shelf portion 138 with the arm extensions 144, as described above, as well as the abutment of the bottom wall portion 105 with the bottoms of the second housing member walls 62 and 72, prevents the first housing member 24 from sliding upward with respect to the second housing member 26. In this manner, a tight and secure locking arrangement between the housing members 24 and 26 is achieved while still allowing the housing members 24 and 26 to be separated from one another, as described earlier, if so desired. With the mounting portion 44 formed as described above with apertured bosses 137, the target assembly can be assembled to the underside of the pinball surface by fastening members extending into and through the bosses 137 and into the bottom of the playing surface 14.

Figure 24:
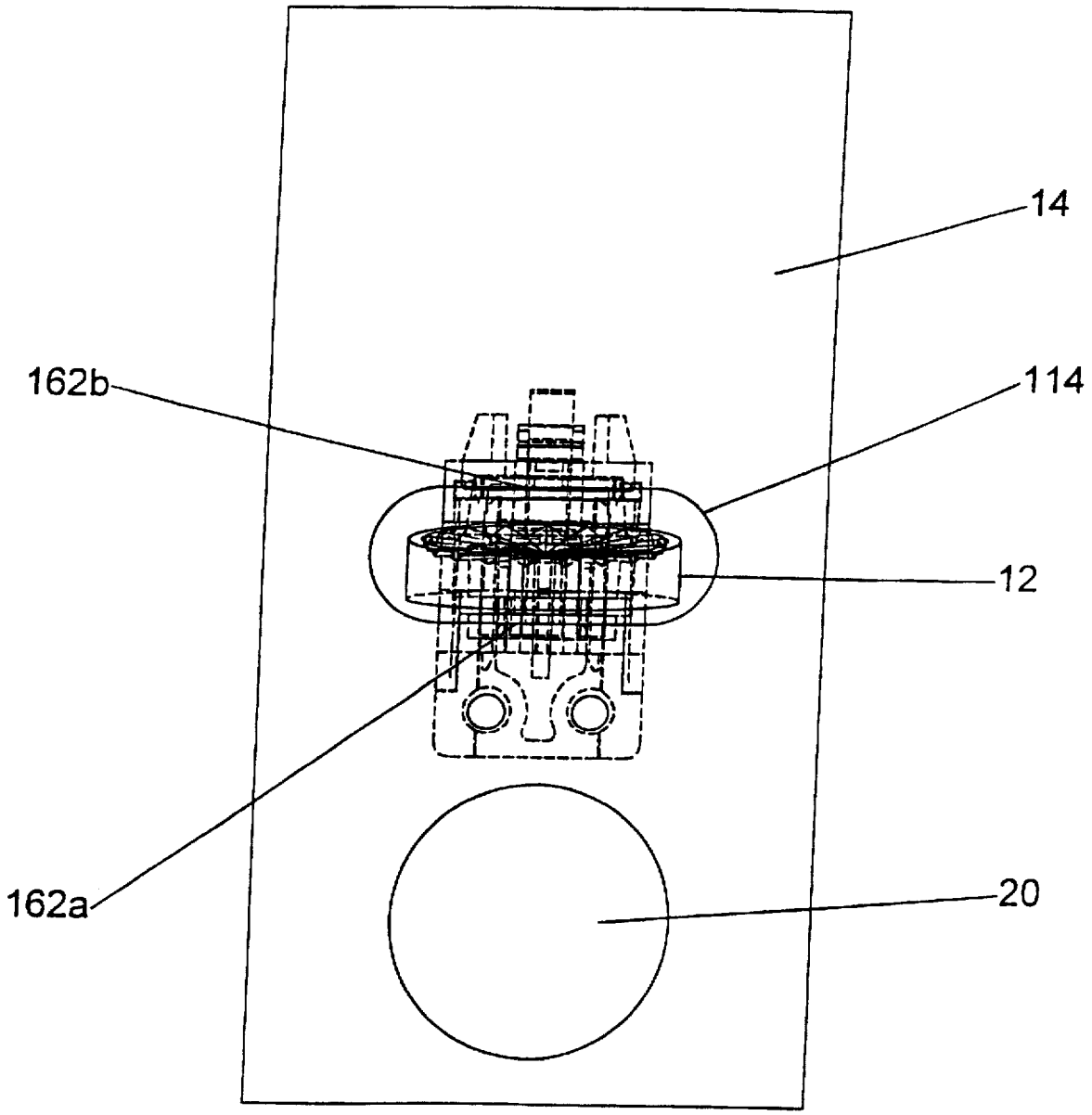
FIG. 24 is a top plan view of the front mount target assembly according to the present invention showing the housing projections engaging flush against either side of the playing surface target slot.
Figure 25:
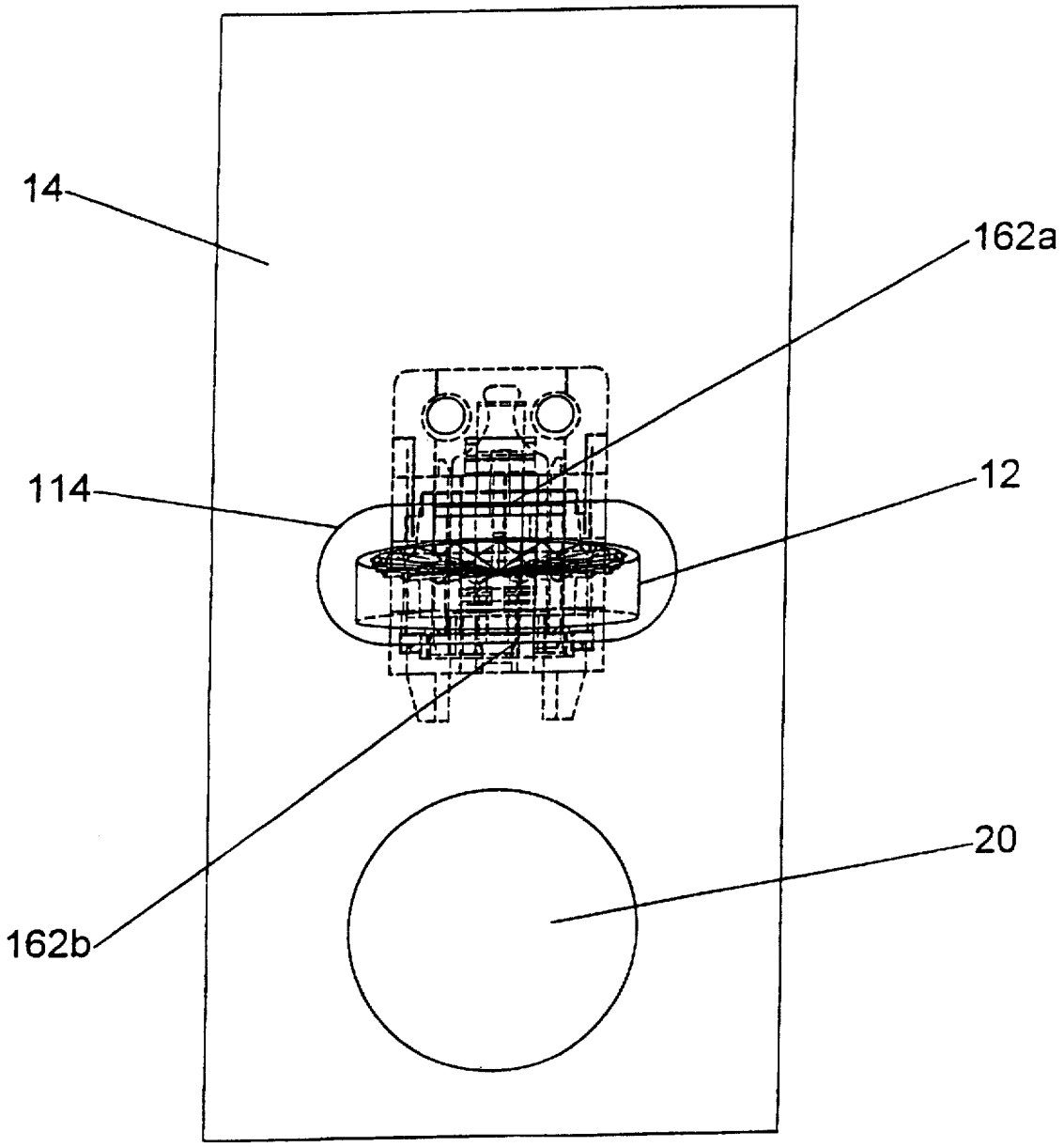
FIG. 25 is a top plan view, similar to FIG. 24, of the rear mount target assembly according to the present invention.
Figure 26:
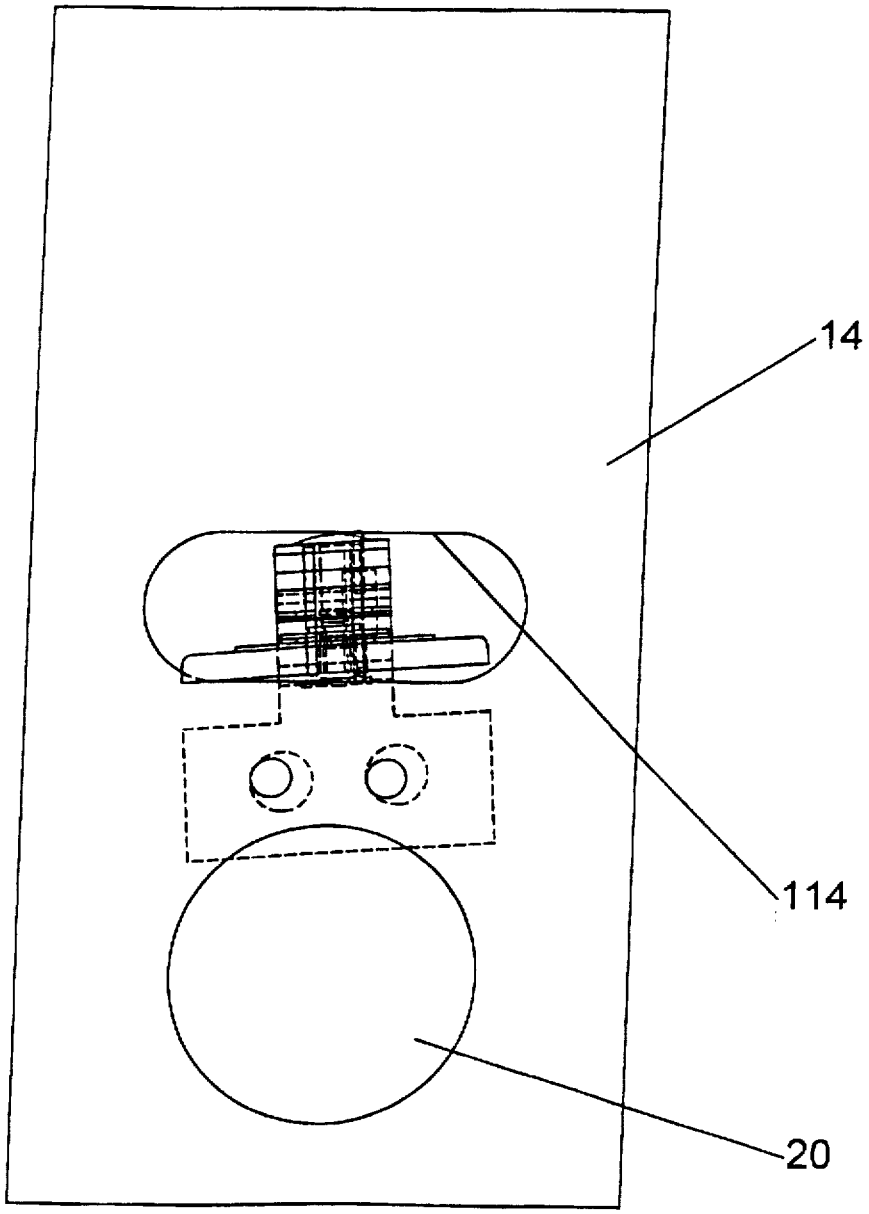
FIG. 26 is a top plan view of the prior art front mount face target assembly showing the potential rotation of the target assembly in the slot after loosening from repeated impacts with the pinball.

As previously mentioned, typically pinball tables 14 have slots 114 cut therein to allow for various game features, such as the prior face target assemblies to be inserted therethrough for positioning the target above the playing surface, as best seen in FIGS. 17 and 26. The target assemblies 10 herein have a pair of projection members 162*a* and 162*b* which extend into the slot and are sized to abut the spaced sides of the slot with the transverse mounting portions 44 mounted to the bottom of the table. With the spacing of the projection members 162*a* and 162*b* substantially corresponding to the spacing across the slot 114, the inventive target assemblies 10 are substantially limited from twisting or being skewed relative to their original mounted position in the slot 114. This is contrary to the prior art face target assemblies as with these prior assemblies their mounts do not engage the sidewalls of the slot 114 such that the mounting bracket absorbs a greater amount of the pinball impact force, thus causing the prior assemblies to loosen and twist or skew after repeated pinball impacts, as shown in FIG. 26. By contrast, the spacing of the projection members 162*a* and 162*b* is such that in either the front mount orientation (FIG. 24) or the rear mount orientation (FIG. 25), the projection members 162 will engage the sides of the slot 114 to resist any twisting forces occasioned by pinball impacts with the target head 12.

More specifically and referring to FIGS. 4 and 6, the projection member 162*a* extends upwardly from the shelf portion 138 of the first housing member 24. The projection member 162*a* extends from the innermost edge of the raised central portion 140 on the shelf portion 138 upwardly therefrom. The projection member 162*b* extends upwardly from the proximate end of the arm extensions 144. As the flange lock member 78 of the first housing member 24 is slid in its track formed on the second housing member 26, the projection member 162*a* will be slid upward between the arm extensions until the members 24 and 26 are releasably locked together with the projection member 162*a* extending upwardly to the same height above the top of the arm extensions 144 as the projection member 162*b*. The height of these projection members 162 over the top of the arm extensions 144 is predetermined so that with the transverse mounting portion 144 attached to the bottom of the playing surface 14 and with the top of the arm extensions 144 abutting the bottom of the playing surface 14, the projection members 162 will project in the slot 114, but not above the playing surface 14, as best seen in FIGS. 10 and 11.

The projection members 162 also act as stops for the elongate bar portion 46 as in the pre-impact position, the bar 46 will abut the front projection member 162, as best seen in FIG. 10. When the impact surface 18 receives a pinball impact, the pivoting action of the unitary member 28 can cause the bar 46 to move against the rear projection member 162, as best seen in FIG. 11. After impact, the bar 46 rebounds back to its pre-impact position against the forward projection member 162. As the projection members 162 are relatively rigid compared to the leaf spring members used in prior face target assemblies, they do not fatigue as readily over time even though they, along with the plunger compression spring, absorb most of the impact energy of the pinball 20 on the target head 12. In this manner, the target assembly 10 herein is provided with a tightly fitting mounting assembly in both its forward and rear mount orientations which substantially limits or prevents any twisting or skewing of the target head 12 relative to the playing surface 14 even after prolonged use and exposure to high repetitions of pinball impacts.

Figure 27:
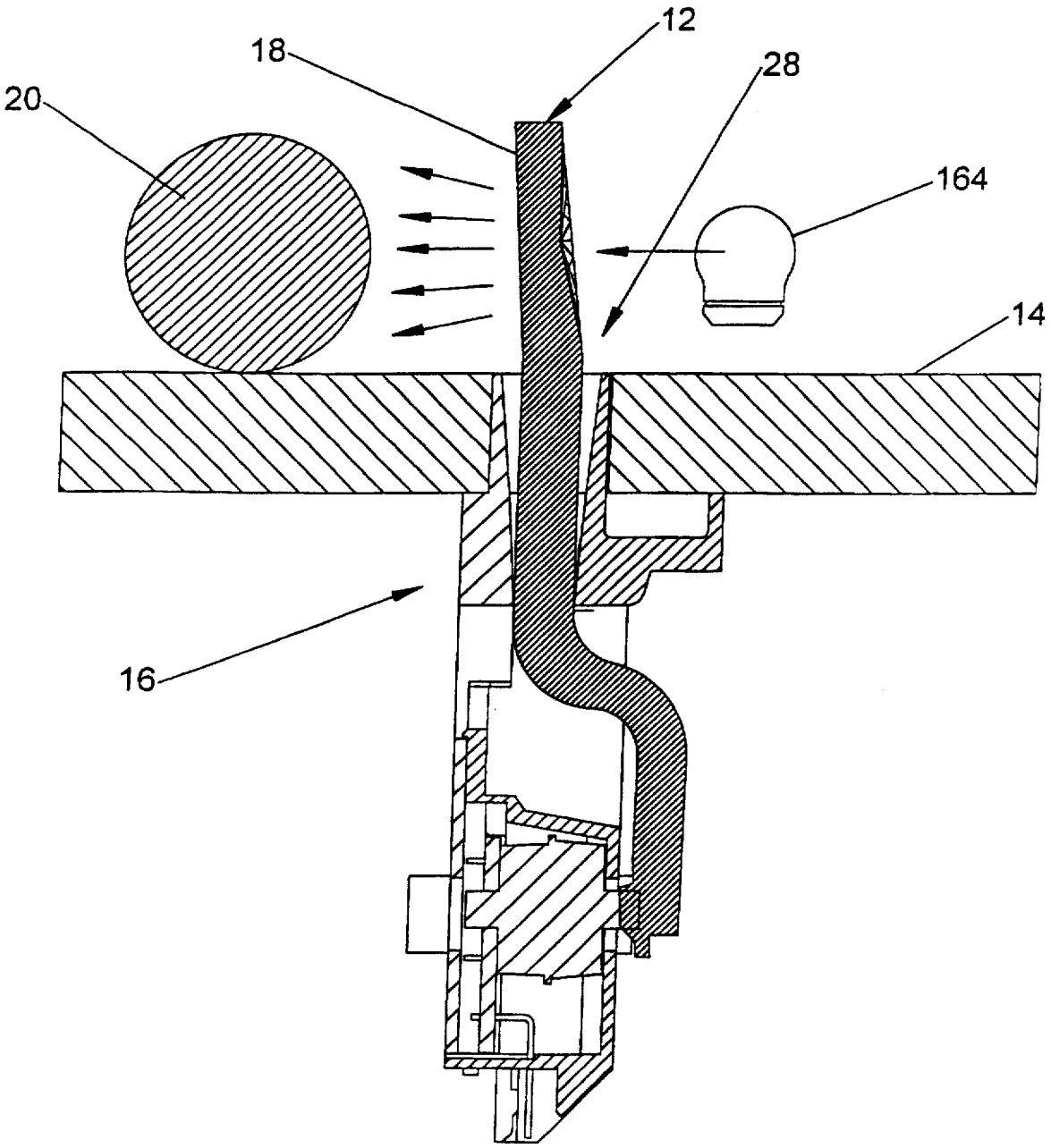
FIG. 27 is a sectional view of the rear mount target assembly according to the present invention with a light source illustrated schematically behind the target directing light through the target head.
Figure 28:
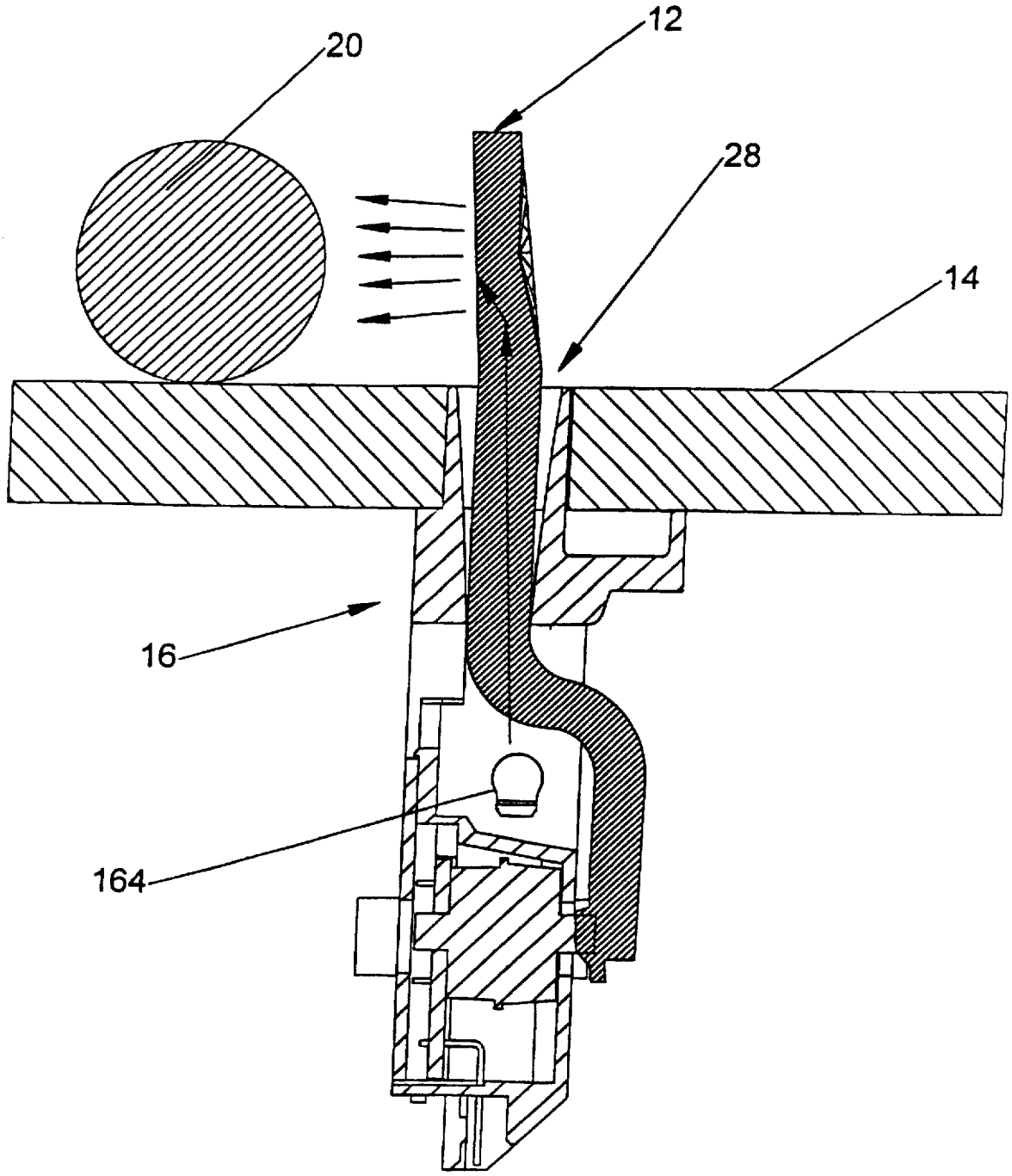
FIG. 28 is a sectional view, similar to FIG. 27, showing the light source illustrated schematically mounted in the housing mount and directing light through the target body and the head.

As the unitary elongate member 28 is preferably molded from a light transmissive material, such as a plastic light transmissive material, it is possible to direct light from a light source 164 therethrough, as shown in FIGS. 27 and 28. Since the target head 12 is the only part of the target assembly 10 herein which extends above the playing surface 14, there is greater flexibility in positioning the light source 164 at locations behind the target head 12 for directing light through the target head 12 to illuminate the impact surface 18 thereof than with the prior face target assemblies which have support and leaf spring members extending above the playing surface behind the target head as well as having a metallic rivet extending through the center of the target head. The support members and rivet impeded any light from a light source mounted behind the prior target heads and, as such, any light source for illuminating the target head generally had to be mounted at other locations proximate the target head to illuminate the area in front of the target head.

In addition, the construction of the reversible housing mount 16 and the unitary elongate member 28 readily allows a light source to be mounted in the housing mount 16 for directing light through the elongate member 28 utilizing the elongate member 28 as a light pipe for transmitting light therethrough, as seen in FIG. 28. It will be apparent that with the target assembly 10 herein, the light source 164 can be mounted in a wide variety of other locations while still directing light in a generally unimpeded path through the target head 12 to illuminate the impact surface 18.

Figure 3:
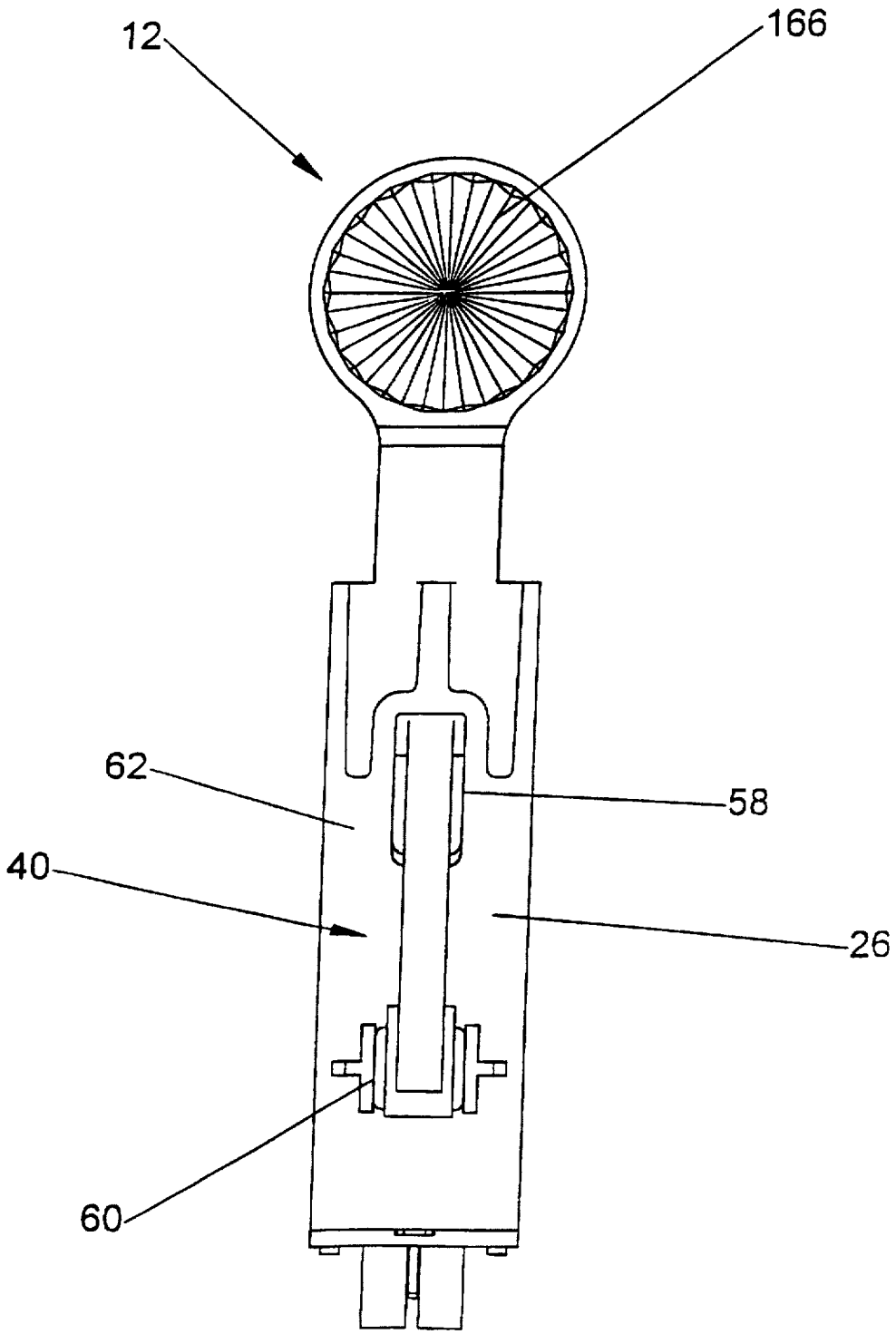
FIG. 3 is a rear elevational view of the target assembly of FIG. 1 showing a rear fluted face of the target head.

While the impact surface 18 can be made in a wide variety of different configurations to effect the rebound path of a pinball 20 rebounding therefrom, it is also desirable to present an aesthetically appealing design of the target head 12. Since the target head 12 is made from light transmissive material, any light transmitted through the target head will typically illuminate the entire target head 12, including the front 18 and rear surface 166 thereof. Thus, without interfering with the impact surface 18 configuration, the target head rear surface 166 can have a distinct design such that when the target head 12 is illuminated, the rear surface design will be readily visible to a player through the impact surface 18 of the target head 12. One preferred configuration for the rear surface 166 is illustrated in FIG. 3 with the rear surface 166 there having a fluted design so that when the target head 12 is illuminated by light source 164, the impact surface 18 will have a radially finned appearance. Of course, other configurations for the rear surface 166 can be readily employed to achieve superior aesthetics over prior face target assemblies.

Figure 29:
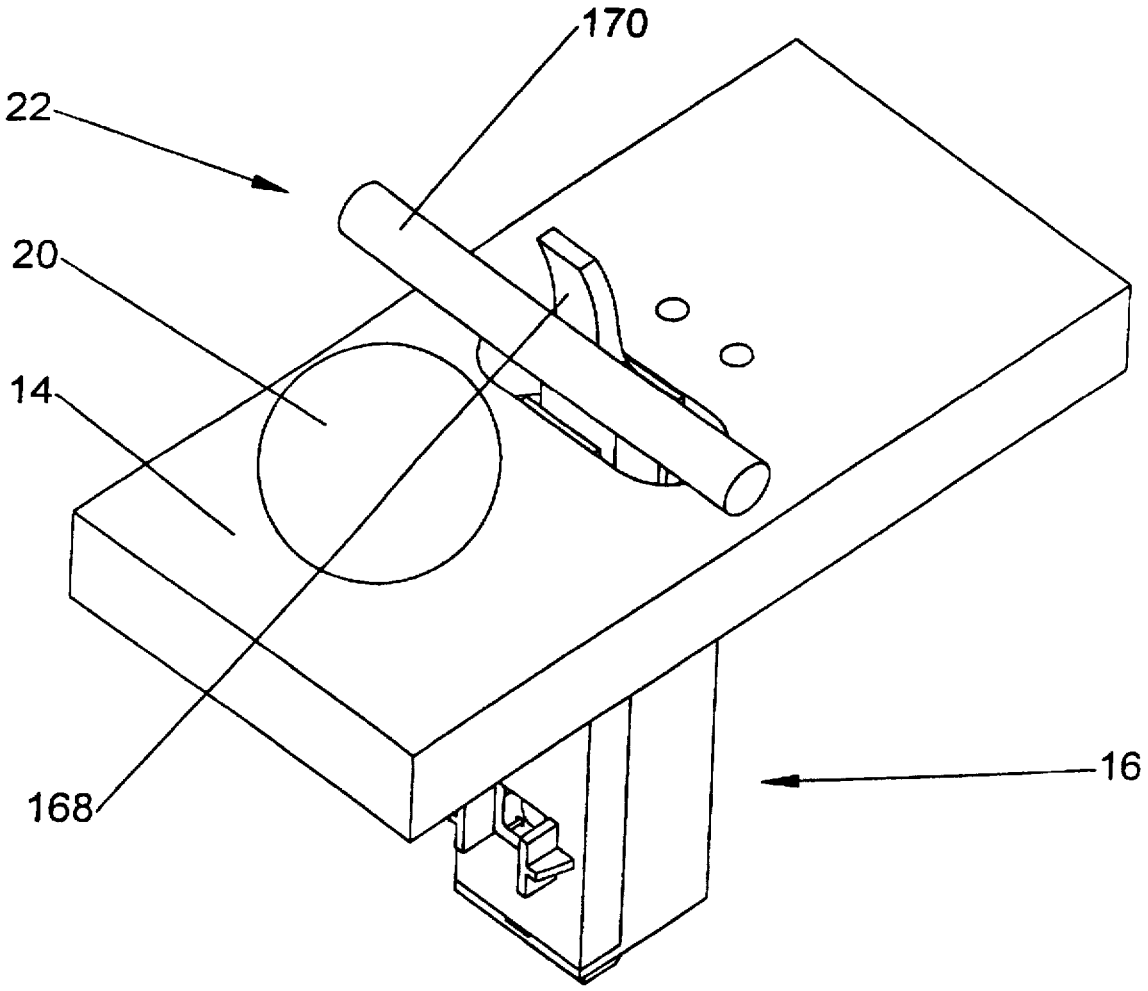
FIG. 29 is a perspective view of an impact receiving and impact sensing apparatus according to the present invention showing the housing mount supporting a modified finger projection target head above the playing surface behind a portion of a sling member which receives impacts from a pinball.
Figure 30:
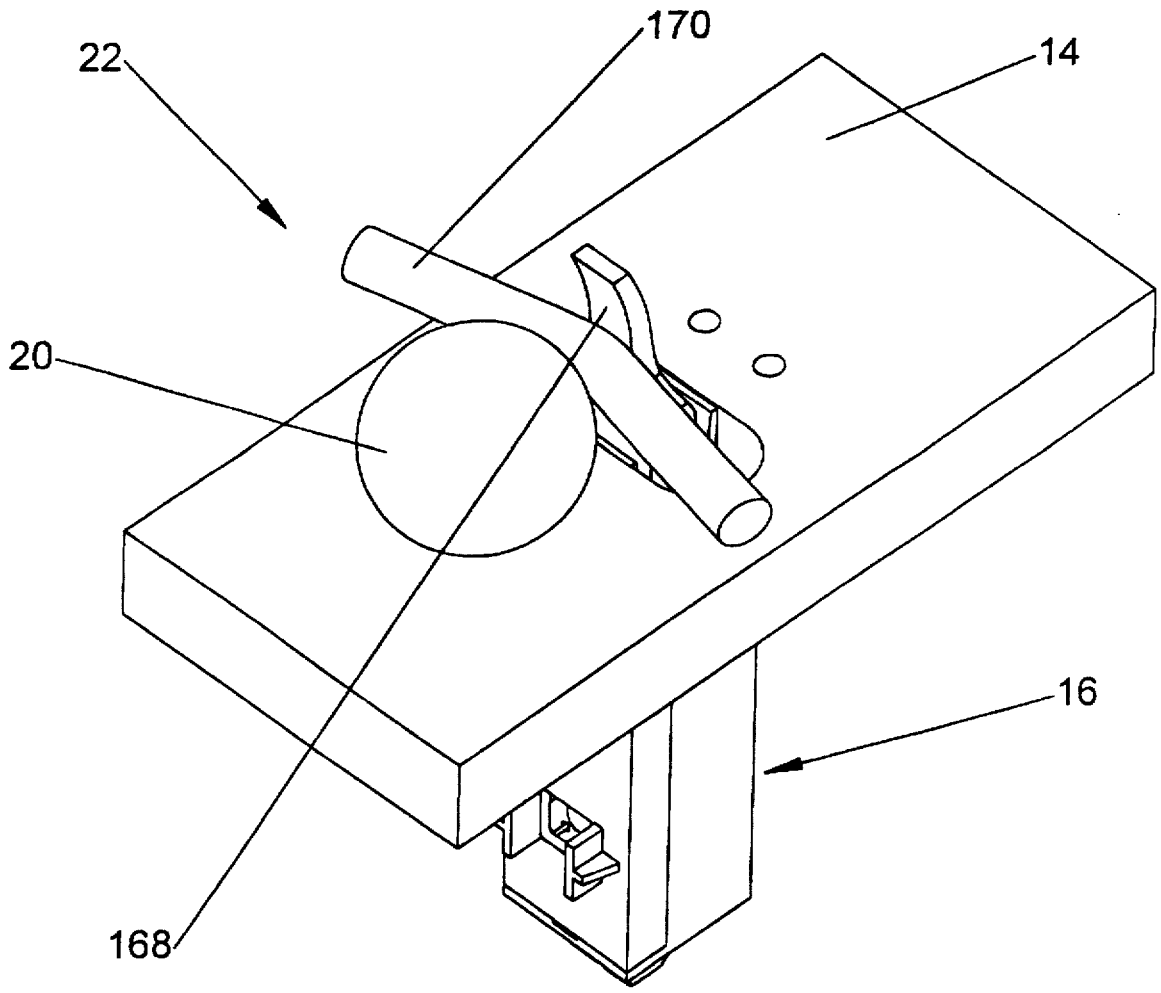
FIG. 30 is a perspective view, similar to FIG. 29 showing the pinball impacting the sling member portion and moving the finger projection rearwardly.

As previously mentioned, the impact receiving and sensing mechanism or target assembly 10 herein can be utilized with other intermediate members placed between it and pinball 20 traveling along the playing surface 14. As seen FIGS. 29 and 30, a portion of a sling device 22 is illustrated with the upper end of the unitary elongate member 28 modified from its target head 12 form so that it is simply a finger projection 168 extending over the playing surface 14 behind the sling device 22. Typically, sling devices 22 include a triangular shaped piece mounted on the pinball playing surface 14 just above and on either side of the lower pinball propelling paddles (not shown). The sling device 22 includes a resilient band 170, typically formed from a rubber material, wrapped around the triangular piece with the rubber band 170 deflecting upon impact with a pinball. The sling device 22 can be solenoid driven so that once a pinball 20 impacts the band 170, as illustrated in FIG. 30, the band 170 will be driven to rebound back to its original, undeflected position as illustrated in FIG. 29 to shoot the ball off of the sling device 22. With the impact receiving and sensing mechanism 10 herein behind the sling device 22, deflection of the band portion 170 of the sling device 22 will also move the finger portion 168 from its pre-impact position rearward to sense point scoring hits on the band 170 of the sling device 22. As will be apparent to one skilled in the art, the target assembly 10 herein can be similarly used in conjunction with other devices on the pinball playing surface 14 for sensing impacts thereon.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. In a pinball machine having a playing surface and a target located above the playing surface for receiving an impact force from a pinball traveling along the playing surface with the target having an impact sensing mechanism associated therewith, the target and associated impact sensing mechanism comprising:

a target head above the pinball playing surface and movable from a first position above the playing surface to a second position above the playing surface upon receiving a sufficient impact force from the pinball;

a switch actuator depending from the head extending below the playing surface in the interior of the pinball machine;

a switch having an open state and a closed state with the switch actuator changing the switch from its open state to its closed state as an incident of the movement of the target head from the first position to the second position; and a housing mount below the playing surface containing the switch to protect the switch from the environment and supporting the target head above the playing surface with the actuator in position to change the switch from its open state to its closed state, the housing mount comprising housing members latched together without requiring distinct fastening members to contain the switch for providing an easy to assemble target impact sensing mechanism.

2. The pinball machine target and impact sensing mechanism of claim 1 wherein the housing mount has top and bottom walls, forward and rear walls, and side walls extending between the forward and rear walls and the top and bottom walls with the walls defining a switch chamber in which the switch is mounted.

3. The pinball machine target and impact sensing mechanism of claim 1 wherein the switch actuator comprises a target lever arm and a pivot between the target lever arm and the target head with the target head pivoting about the pivot as it moves between the first and second positions.

4. The pinball machine target and impact sensing mechanism of claim 3 wherein the target head, pivot and target lever arm are integrally formed from a plastic material.

5. The pinball machine target and impact sensing mechanism of claim 3 wherein the pivot comprises a pivot shaft extending transversely to the target lever arm.

6. The pinball machine target and impact sensing mechanism of claim 5 wherein the members of the housing mount include a first housing member and second housing member which can be connected to capture and define a seat for the pivot shaft in the housing mount.

7. The pinball machine target and impact sensing mechanism of claim 1 wherein the playing surface has a slot formed therein and the housing mount extends from the slot downwardly into the pinball machine interior with the target head adjacent the slot above the playing surface.

8. The pinball machine target and impact sensing mechanism of claim 1 further comprising a light source with light from the source directed through the target head wherein the target head is formed from a translucent material.

9. The pinball machine target and impact sensing mechanism of claim 1 wherein the pinball machine includes a game controller and the switch includes a switch circuit and the housing mount includes a connector capturing surface for tightly capturing an electrical socket connector against the housing mount to electrically connect the game controller to the switch circuit.

10. In a pinball machine having a playing surface and a target located above the playing surface for receiving an impact force from a pinball traveling along the playing surface with the target having an impact sensing mechanism associated therewith, the target and associated impact sensing mechanism comprising:

a target head above the pinball playing surface and movable from a first position above the playing surface to a second position above the playing surface upon receiving a sufficient impact force from the pinball;

a switch actuator depending from the head extending below the playing surface in the interior of the pinball machine;

a switch having an open state and a closed state with the switch actuator changing the switch from its open state to its closed state as an incident of the movement of the target head from the first position to the second position; and a housing mount below the playing surface containing the switch to protect the switch from the environment and supporting the target head above the playing surface with the actuator in position to change the switch from its open state to its closed state, wherein the playing surface has a slot formed therein and the housing mount extends from the slot downwardly into the pinball machine interior with the target head adjacent the slot above the playing surface and the slot is bounded by first and second spaced laterally extending walls and the housing mount has first and second projection members spaced to engage the walls without projecting above the playing surface and acting as stops to limit the movement of the target head.

11. In a pinball machine having a playing surface and a target located above the playing surface for receiving an impact force from a pinball traveling along the playing surface with the target having an impact sensing mechanism associated therewith, the target and associated impact sensing mechanism comprising:

a target head above the pinball playing surface and movable from a first position above the playing surface to a second position above the playing surface upon receiving a sufficient impact force from the pinball;

a switch actuator depending from the head extending below the playing surface in the interior of the pinball machine;

a switch having an open state and a closed state with the switch actuator changing the switch from its open state to its closed state as an incident of the movement of the target head from the first position to the second position; and a housing mount below the playing surface containing the switch to protect the switch from the environment and supporting the target head above the playing surface with the actuator in position to change the switch from its open state to its closed state, wherein the playing surface has a slot formed therein and the housing mount extends from the slot downwardly into the pinball machine interior with the target head adjacent the slot above the playing surface and the housing mount has a first portion extending downwardly from the playing surface and a second portion extending transversely to the first portion for attachment to the bottom of the playing surface.

12. The pinball machine target and impact sensing mechanism of claim 11 wherein the target head has an impact receiving surface facing in a first direction, and the second housing transverse portion is reversible relative to the target and can be attached to the playing surface bottom extending in either the first direction or a second direction opposite to the first direction with the target head facing in the first direction.

13. In a pinball machine having a playing surface and a target located above the playing surface for receiving an impact force from a pinball traveling along the playing surface with the target having an impact sensing mechanism associated therewith, the target and associated impact sensing mechanism comprising:

a target head above the pinball playing surface and movable from a first position above the playing surface to a second position above the playing surface upon receiving a sufficient impact force from the pinball;

a switch actuator depending from the head extending below the playing surface in the interior of the pinball machine;

a switch having an open state and a closed state with the switch actuator changing the switch from its open state to its closed state as an incident of the movement of the target head from the first position to the second position; and a housing mount below the playing surface containing the switch to protect the switch from the environment and supporting the target head above the playing surface with the actuator in position to change the switch from its open state to its closed state wherein the switch includes an activation plunger having a first position where it is extended with the switch in the open state and a second position where it is depressed by the switch actuator with the switch in the closed state, the plunger normally being biased to its first extended position and moved to the second depressed position against the bias when the target head moves by force of the pinball from its first position to its second position.

14. The pinball machine target and impact sensing mechanism of claim 13 wherein the target head has an impact receiving surface and the housing mount supports the head so that the target head surface moves through a predetermined angular path relative to the playing surface as the head moves between its first and second positions with the plunger bias causing the target head to rebound back to its first position after reaching its second position to propel the pinball away from the target head.

15. In a pinball machine having a playing surface and a target located above the playing surface for receiving an impact force from a pinball traveling along the playing surface with the target having an impact sensing mechanism associated therewith, the target and associated impact sensing mechanism comprising:

a target head above the pinball playing surface and movable from a first position above the playing surface to a second position above the playing surface upon receiving a sufficient impact force from the pinball;

a switch actuator depending from the head extending below the playing surface in the interior of the pinball machine;

a switch having an open state and a closed state with the switch actuator changing the switch from its open state to its closed state as an incident of the movement of the target head from the first position to the second position;

a housing mount below the playing surface containing the switch to protect the switch from the environment and supporting the target head above the playing surface with the actuator in position to change the switch from its open state to its closed state; and a light source with light from the source directed through the target head wherein the target head is formed form a translucent material and the light source is mounted in the housing mount.

16. A target assembly in a pinball machine for receiving an impact force from a pinball traveling along the playing surface with the pinball rebounding therefrom onto the playing surface without being retained by the target, the pinball rebounding target assembly comprising:

a target head having an impact receiving surface and being supported in a first predetermined position above the playing surface for receiving an impact force from a pinball and moving to a second predetermined position above the playing surface in response to the impact force on the impact surface;

a target body extending from the target head below the playing surface with the target body being urged by a predetermined bias force to position the target head in its first predetermined position, the target head moving from its first to its second predetermined position against the predetermined bias force exerted on the target body and then rebounding back to its first predetermined position under the influence of the bias force; and a housing mount mounted below the playing surface for capturing an intermediate portion of the target body and supporting the target body and the target head being formed integrally with the target body such that only the target head of the target assembly protrudes above the playing surface with the entire extent of the target head impact surface being exposed to pinball impacts, the housing mount comprising housing members latched together without requiring distinct fastening members to capture the target body intermediate portion for providing an easy to assemble target assembly.

17. The pinball rebounding target assembly of claim 16 wherein the impact surface faces in a first predetermined direction with the target head in its first predetermined position so than a pinball traveling along the playing surface generally oppositely to the first direction and impacting the impact surface with sufficient impact force will cause the target head to move from its first predetermined position to its second predetermined position.

18. The pinball rebounding target assembly of claim 16 wherein the target body includes an elongate bar portion depending from the target head, a lever arm having a bottom end which is urged by the predetermined bias force, and the intermediate portion which comprises a pivot disposed between the elongate bar and the lever arm about which the target body pivots as the target head moves from one of the first and second predetermined positions to the other of the first and second predetermined positions.

19. The pinball rebounding target assembly of claim 18 wherein the pivot is a pivot shaft extending transverse to the elongate bar and the lever arm with the target head, the elongate bar portion, the pivot shaft and the lever arm being integrally formed from a plastic material.

20. The pinball rebounding target assembly of claim 16 wherein the target impact surface is angled relative to the playing surface at a preselected angle to provide the pinball with a consistent path upon rebounding from the target impact surface.

21. The pinball rebounding target assembly of claim 16 wherein the target impact surface has central and side sections and a predetermined convex shape with the central section extending outward beyond the side sections of the impact surface.

22. The pinball rebounding target assembly of claim 16 wherein the target head is formed from a translucent plastic material and has a rear surface opposite to the impact receiving surface with the rear surface being fluted to provide a radially finned appearance to the impact surface upon directing light from a source through the rear surface.

23. A pinball impact receiving and impact sensing apparatus comprising:

an elongate member having a first section extending above a pinball machine playing surface in a first predetermined position and having a predetermined orientation relative to the playing surface for receiving an impact force, and a second section extending below the pinball machine playing surface;

a sensing mechanism for sensing movement of the first section to a second predetermined position above the playing surface upon receiving the impact force; and a reversible mount supporting a portion of the elongate member to maintain the elongate member first section above the playing surface at the first predetermined position in its predetermined orientation, the reversible support having a transverse portion adapted to be secured to the bottom of the playing surface extending in one of a first direction relative to the first section orientation and a second direction substantially opposite to the first direction with the elongate member first section in said predetermined orientation wherein the transverse portion is capable of being reversed to extend in the other of the first and second directions with the elongate member first section in said predetermined orientation.

24. The impact receiving and sensing apparatus of claim 23 wherein the elongate member first section is a target head having an impact surface with a pinball capable of engaging the impact surface for impacting thereagainst.

25. The impact receiving and sensing apparatus of claim 23 wherein the reversible mount comprises a first housing member and a second housing member connectable to each other to capture the elongate member portion and allow movement of the elongate member first section between its first and second positions with the mount secured below the playing surface.

26. The impact receiving and sensing apparatus of claim 25 wherein the elongate member captured portion includes a pivot shaft and one of the first and second housing members has a support bearing surface for the pivot shaft and the other of the first and second housing members captures the pivot shaft on the bearing surface when the housing members are connected.

27. The impact receiving and sensing apparatus of claim 25 wherein the first and second housing members are formed from a plastic material.

28. The impact receiving and sensing apparatus of claim 25 wherein the one housing member includes a flanged lock member and the other housing member has flange receiving track with the lock member and track cooperating to releasably assemble the housing members to each other without the use of distinct fastening members.

29. The impact receiving and sensing apparatus of claim 25 wherein the sensing mechanism includes a switch having an activation plunger and the elongate member second section includes a lever arm portion engaged with the activation plunger for depressing the plunger as the elongate member first section moves from its first predetermined position to its second predetermined position.

30. The impact receiving and sensing apparatus of claim 29 wherein the first and second housing members each include a pair of openings through which the lever arm and plunger can extend so that with the first section in its first predetermined position the lever arm can engage the plunger at a position exterior of the housing members with the lever arm and plunger extending through the pair of openings of either one of the first or second housing members.

31. The impact receiving and sensing apparatus of claim 29 wherein the switch is mounted on a printed circuit board having electrical leads extending therefrom for transmitting an electrical signal from the switch when the activation plunger is depressed.

32. The impact receiving and sensing apparatus of claim 23 wherein the sensing mechanism includes a switch having an activation plunger and the elongate member second section includes a lever arm portion engaged with the activation plunger for depressing the plunger as the elongate member first section moves from its first predetermined position to its second predetermined position and the switch is mounted to the reversible mount which includes a pair of opposed apertures to allow the switch to be reversed so that the plunger can extend through either one of the opposed apertures into engagement with the lever arm.

33. The impact receiving and sensing apparatus of claim 25 wherein the first and second housing members cooperate to define mounting apertures extending through the mount transverse portion for receipt of fasteners therethrough to secure the transverse portion to the bottom of the playing surface.

* * * * *